US008881753B2

(12) United States Patent
Rowley

(10) Patent No.: US 8,881,753 B2
(45) Date of Patent: Nov. 11, 2014

(54) GROUND BLIND

(76) Inventor: Victor Rowley, Versailles, MO (US)

( * ) Notice: Subject to any disclaimer, the term of this patent is extended or adjusted under 35 U.S.C. 154(b) by 0 days.

(21) Appl. No.: 13/485,270

(22) Filed: May 31, 2012

(65) Prior Publication Data

US 2013/0319490 A1 Dec. 5, 2013

(51) Int. Cl.
*E04H 15/48* (2006.01)

(52) U.S. Cl.
USPC ..... 135/144

(58) Field of Classification Search
USPC ..... 135/128, 130, 144, 143, 153, 901, 906
See application file for complete search history.

(56) References Cited

U.S. PATENT DOCUMENTS 3,003,507 A * 10/1961 Ferris ..... 135/128
3,133,549 A * 5/1964 Severing ..... 135/153
3,913,598 A * 10/1975 Glutting et al. ..... 135/152
5,058,863 A * 10/1991 Maffet ..... 256/26
5,379,786 A * 1/1995 Lynam ..... 135/87
5,414,950 A * 5/1995 Johnson, Sr. ..... 43/1
5,722,477 A * 3/1998 Richter et al. ..... 160/135
5,906,217 A * 5/1999 Hill ..... 135/124
6,892,743 B2 * 5/2005 Armstrong et al. ..... 135/143
7,225,823 B1 * 6/2007 Ransom et al. ..... 135/126
7,789,099 B2 * 9/2010 Mallookis et al. ..... 135/145
2009/0014044 A1 * 1/2009 Hartman et al. ..... 135/143

OTHER PUBLICATIONS

Web Page; Shelters of America; Temporary portable garage carports all weather shelter portable storage garage building . . . ; http://www.sheltersofamerica.com/; dated Apr. 27, 2012.

* cited by examiner

*Primary Examiner* — Noah Chandler Hawk
(74) *Attorney, Agent, or Firm* — Hovey Williams LLP

(57) ABSTRACT

A ground blind broadly includes a frame assembly and a cover that define an interior space. The frame assembly includes an articulated frame with a plurality of frame sections. The frame sections are attached in series with one another and are pivotal into and out of a folded position. The articulated frame is shiftable between a collapsed configuration where each adjacent pair of frame sections is moved into a folded position so that the frame sections are stacked in series with one another and an erected configuration where each adjacent pair of frame sections is moved out of the folded position so that the articulated frame spans an erected area.

24 Claims, 21 Drawing Sheets

GROUND BLIND

BACKGROUND

1. Field

The present invention relates generally to erected enclosures and shelters. More specifically, embodiments of the present invention concern a ground blind operable to be used by one or more hunters and operable to be selectively erected and collapsed.

2. Discussion of Prior Art

Various types of prior art collapsible enclosures and shelters have been used for a wide range of outdoor applications such as camping, hunting, and storage. For instance, conventional collapsible tents tend to be very lightweight and have long been used by campers, hunters, and hikers. Some prior art collapsible enclosures are also designed for use as a hunting blind. Such conventional blinds have different shapes and sizes and are also operable to be either erected or collapsed in a matter of seconds.

Conventional collapsible enclosures and shelters have certain deficiencies. For those that are very light and portable, such structures are also known to lack rigidity when erected. Consequently, these enclosures perform poorly in adverse weather conditions such as high winds, rain, and heavy snow. At the same time, larger conventional enclosures and shelters are known to be heavy and bulky, are difficult for one or two people to quickly erect or collapse, and are difficult for one or two people to manually transport. In particular, larger prior art hunting blinds tend to be constructed of rigid building materials so that the blind is highly weather resistant but difficult for a person to transport without the assistance of a powered vehicle.

SUMMARY

The following brief summary is provided to indicate the nature of the subject matter disclosed herein. While certain aspects of the present invention are described below, the summary is not intended to limit the scope of the present invention.

Embodiments of the present invention provide a ground blind that does not suffer from the problems and limitations of the prior art enclosures set forth above.

An embodiment of the present invention concerns a ground blind broadly including a frame assembly and a cover. The frame assembly includes an articulated frame that extends between and presents opposite frame ends. The cover is attached to the frame assembly so that the frame assembly and cover cooperatively define an interior space. The articulated frame includes a plurality of rigid frame sections that each define a framed area. The frame sections are attached in series with one another to extend continuously between the frame ends and present multiple adjacent pairs of frame sections. Each of the adjacent pairs of frame sections is pivotally attached to one another by at least one pivot joint so as to be pivotal into and out of a folded position where the framed areas are positioned adjacent one another. The articulated frame is shiftable between a collapsed configuration where each of the adjacent pairs of frame sections are moved into the folded positions so that the frame sections are stacked in series with one another and an erected configuration where each of the adjacent pairs of frame sections are moved out of the folded positions so that the articulated frame spans an erected area along the interior space greater than the framed area.

Other embodiments and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein:

FIG. 1 is a front perspective of a ground blind constructed in accordance with a first embodiment of the present invention, with the ground blind including a frame assembly, and a cover assembly with a main cover and a removable front end cover, and with a central section of the main cover including flaps in a closed position and a plurality of laterally spaced loops to receive camouflaging brush, and showing the front end cover with flaps and a door in a closed position, and further showing an anchoring assembly to secure the ground blind along the ground;

Figure 1:
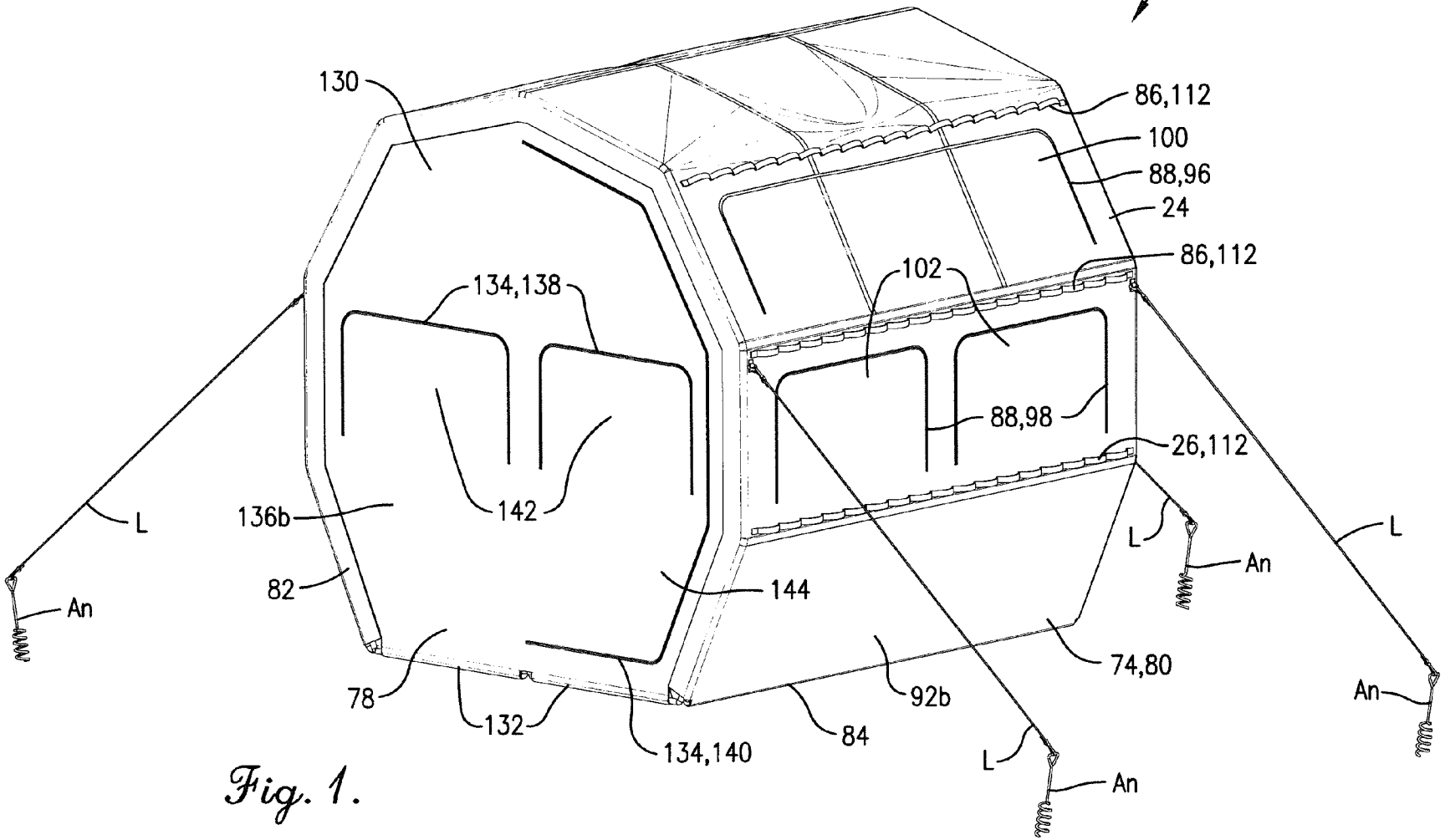
Figure 2:
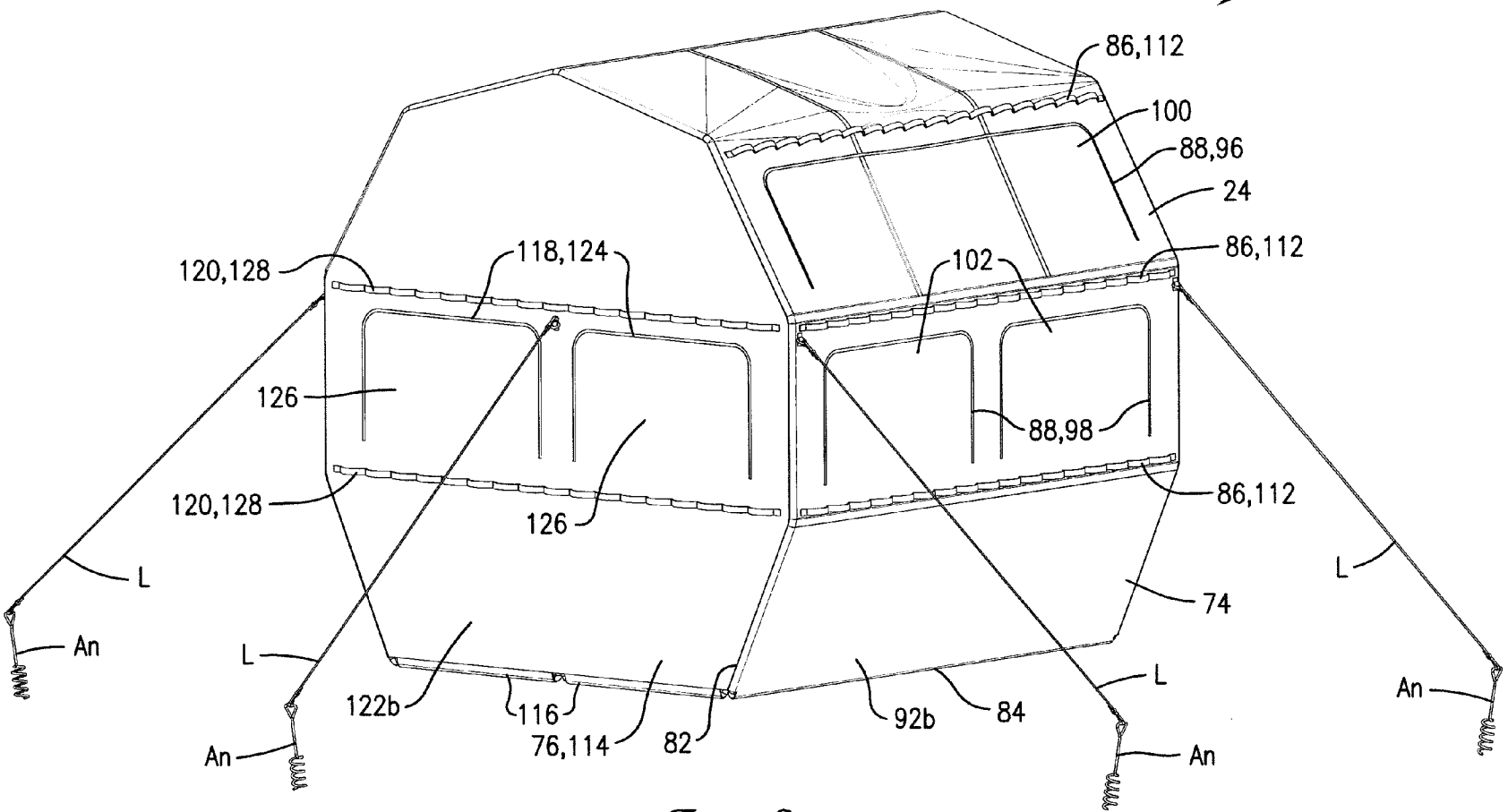
FIG. 2 is a rear perspective of the ground blind and anchoring assembly shown in FIG. 1, showing additional flaps along the central section of the main cover in the closed position and additional spaced loops spaced laterally along the central section, and also showing a fixed back end cover attached to the main cover, with the fixed back end cover including flaps in the closed position.
Figure 3A:
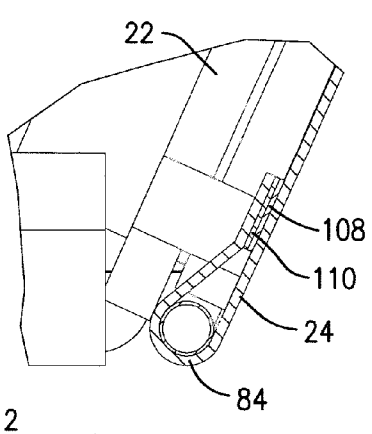
FIG. 3 is a front perspective of the ground blind similar to FIG. 1, but showing the door and several of the flaps in open positions, with parts of the frame assembly and the interior of the ground blind being viewable from outside the blind.
Figure 3:
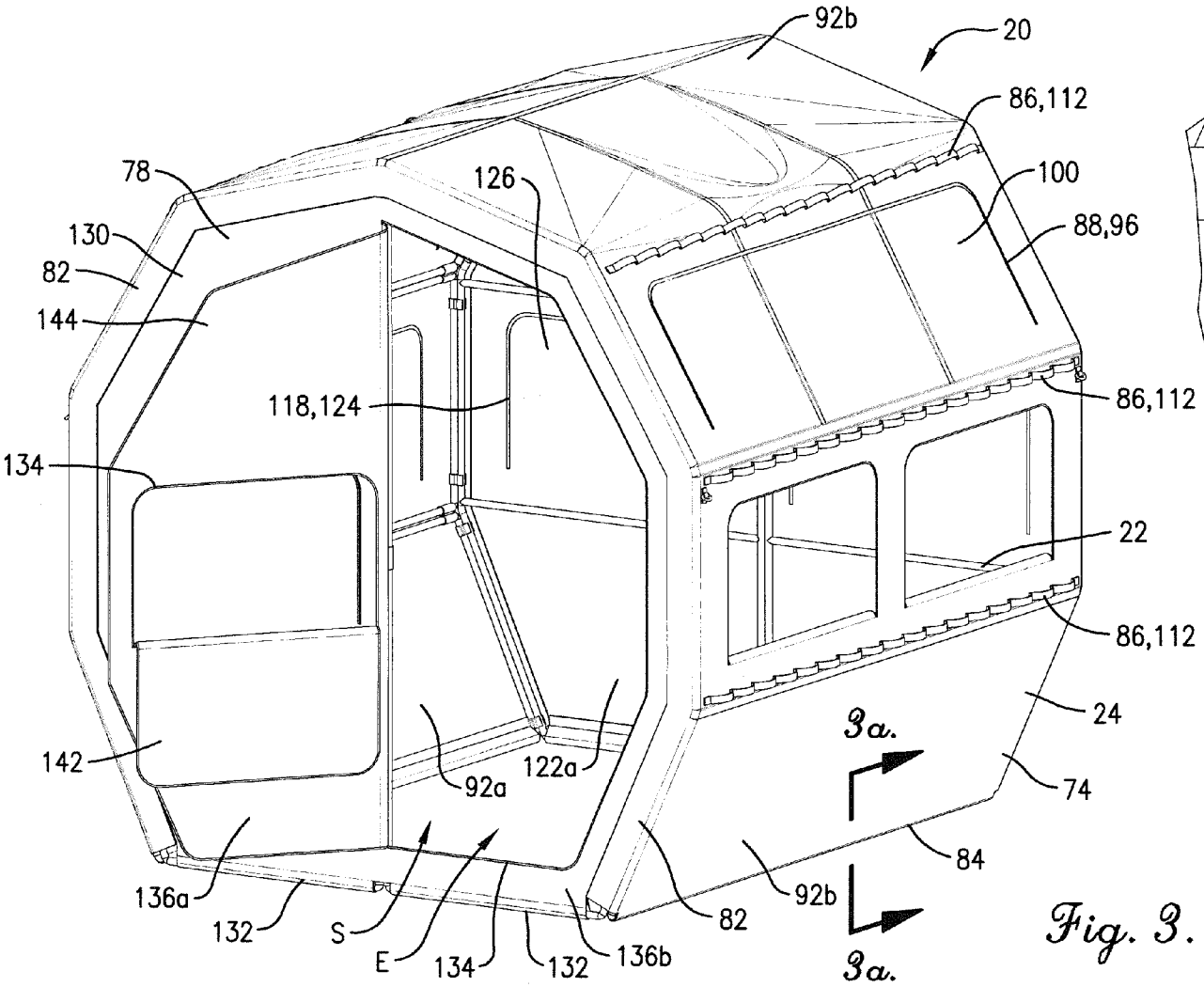
Figure 4:
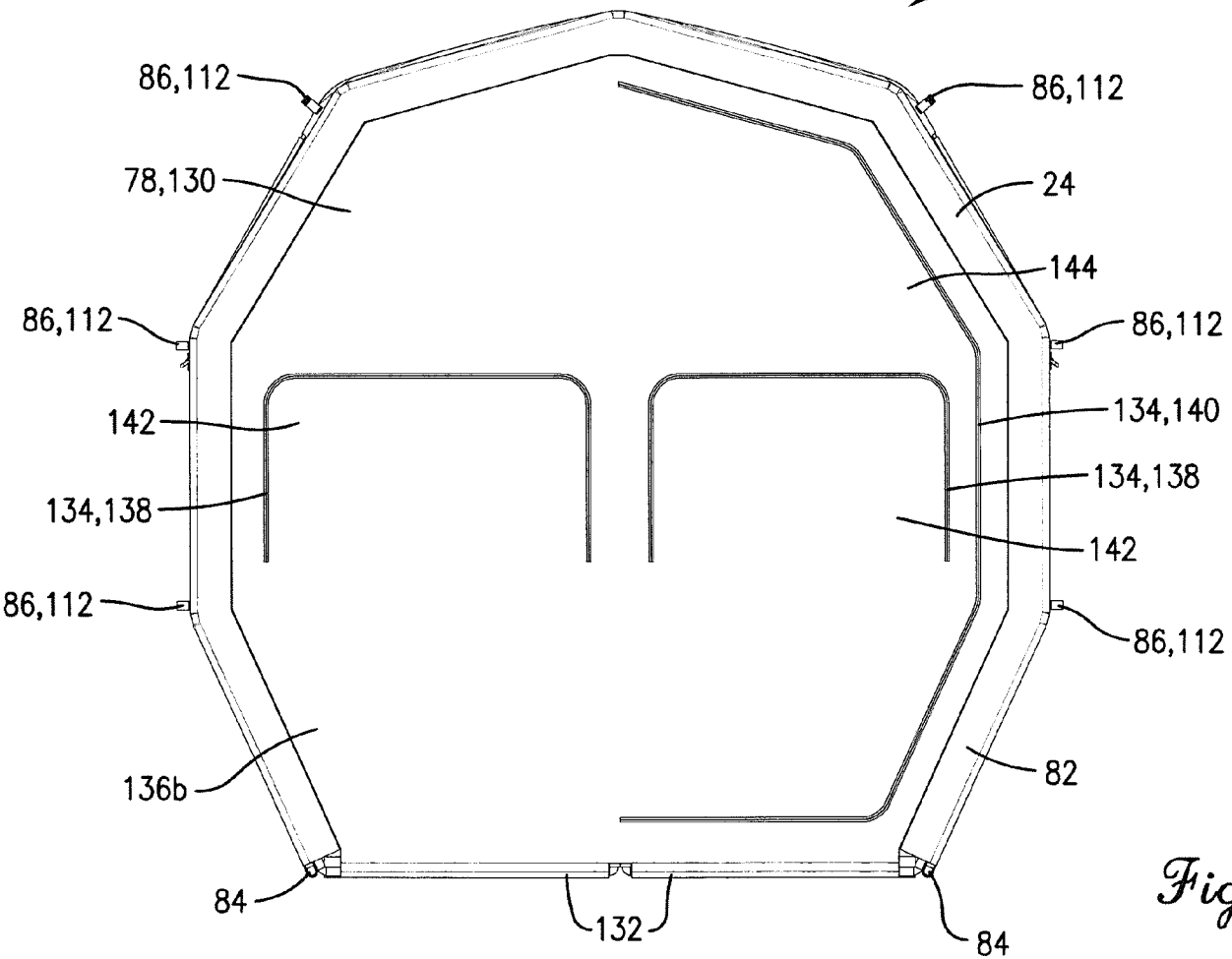
Figure 5:
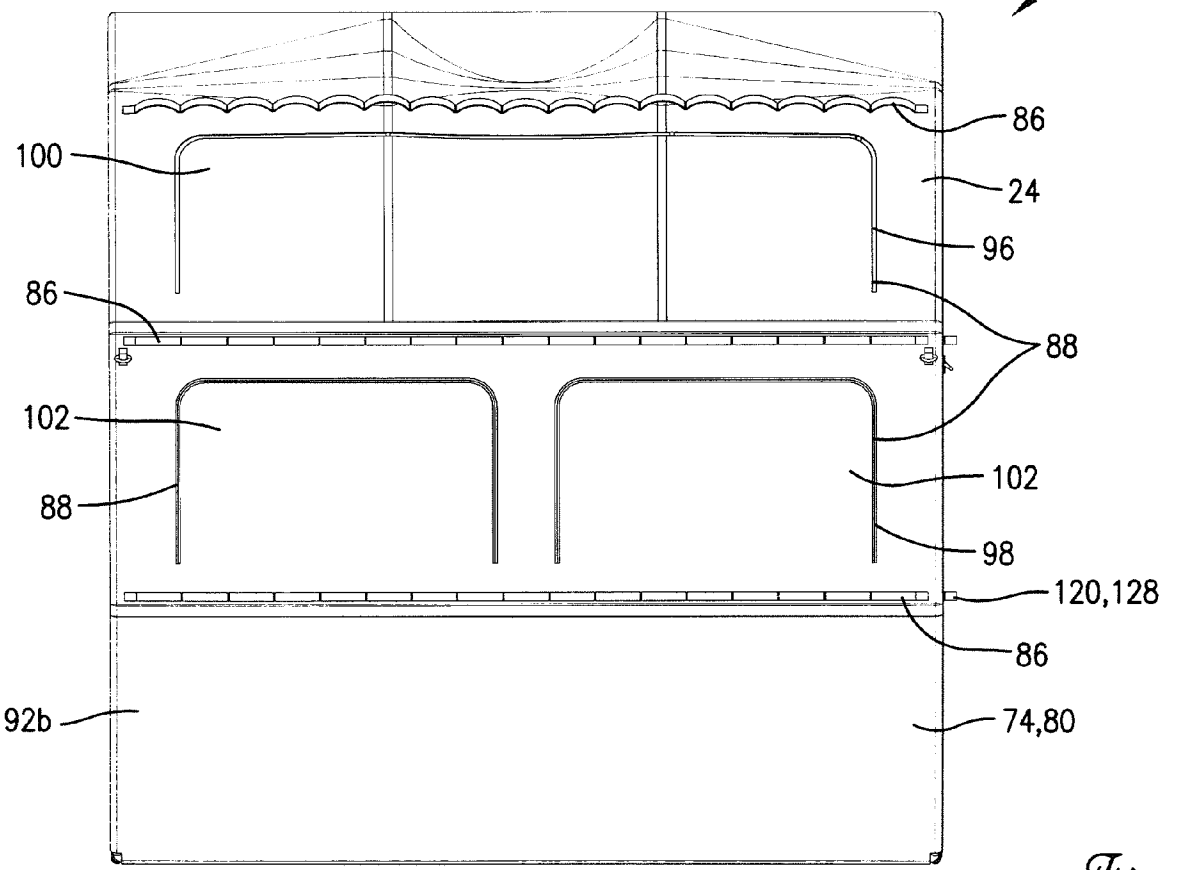
Figure 6:
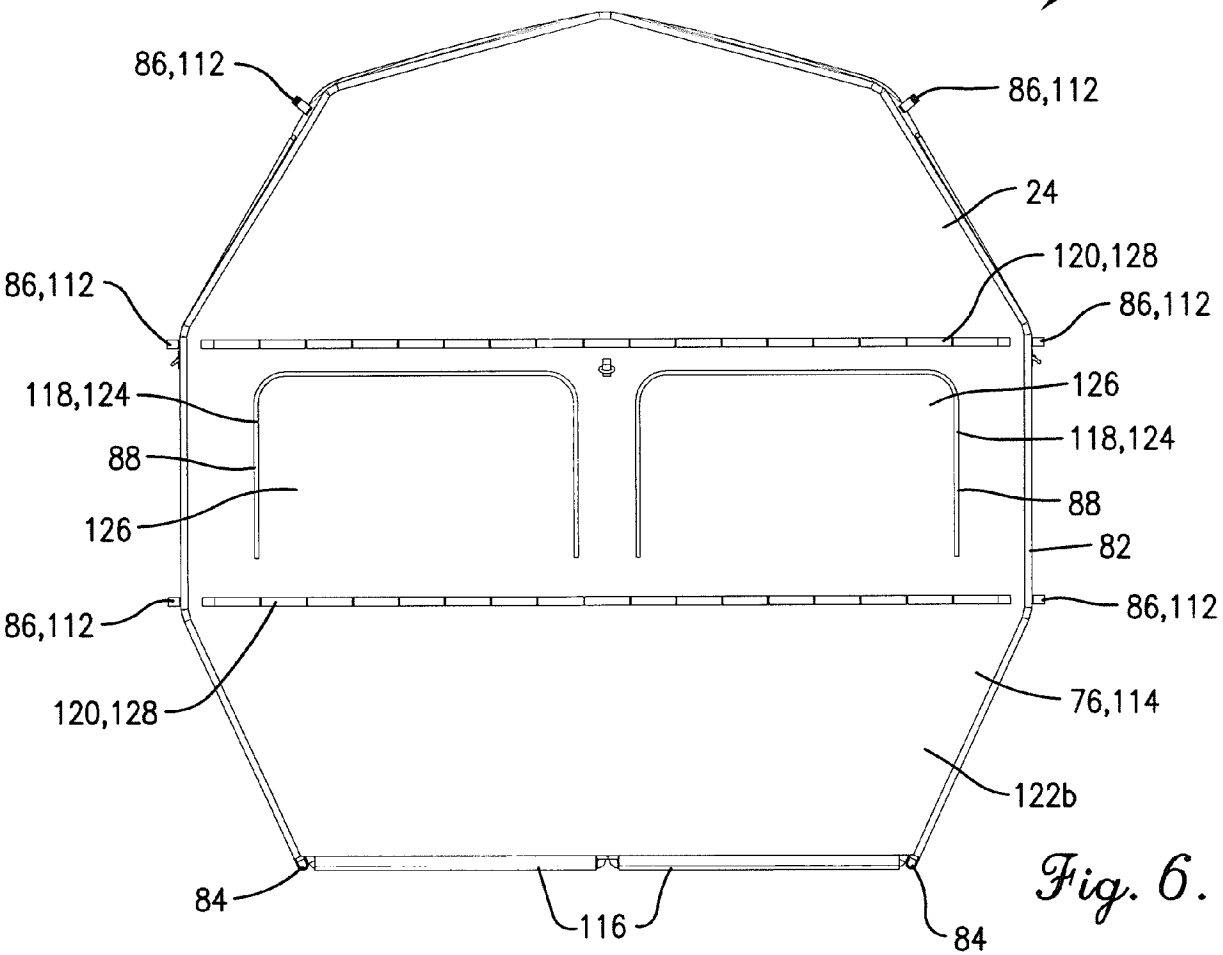
Figure 7:
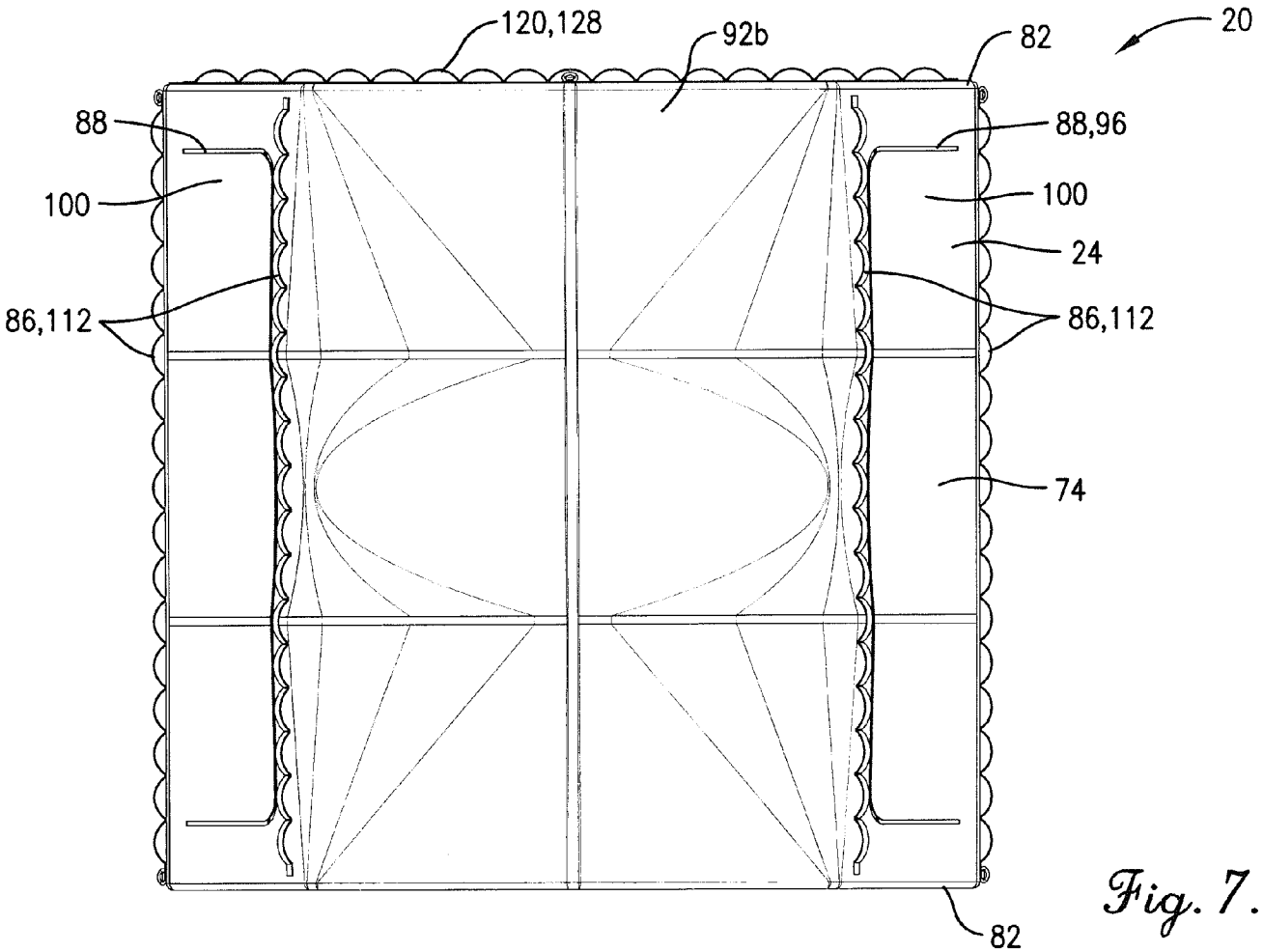
Figure 8:
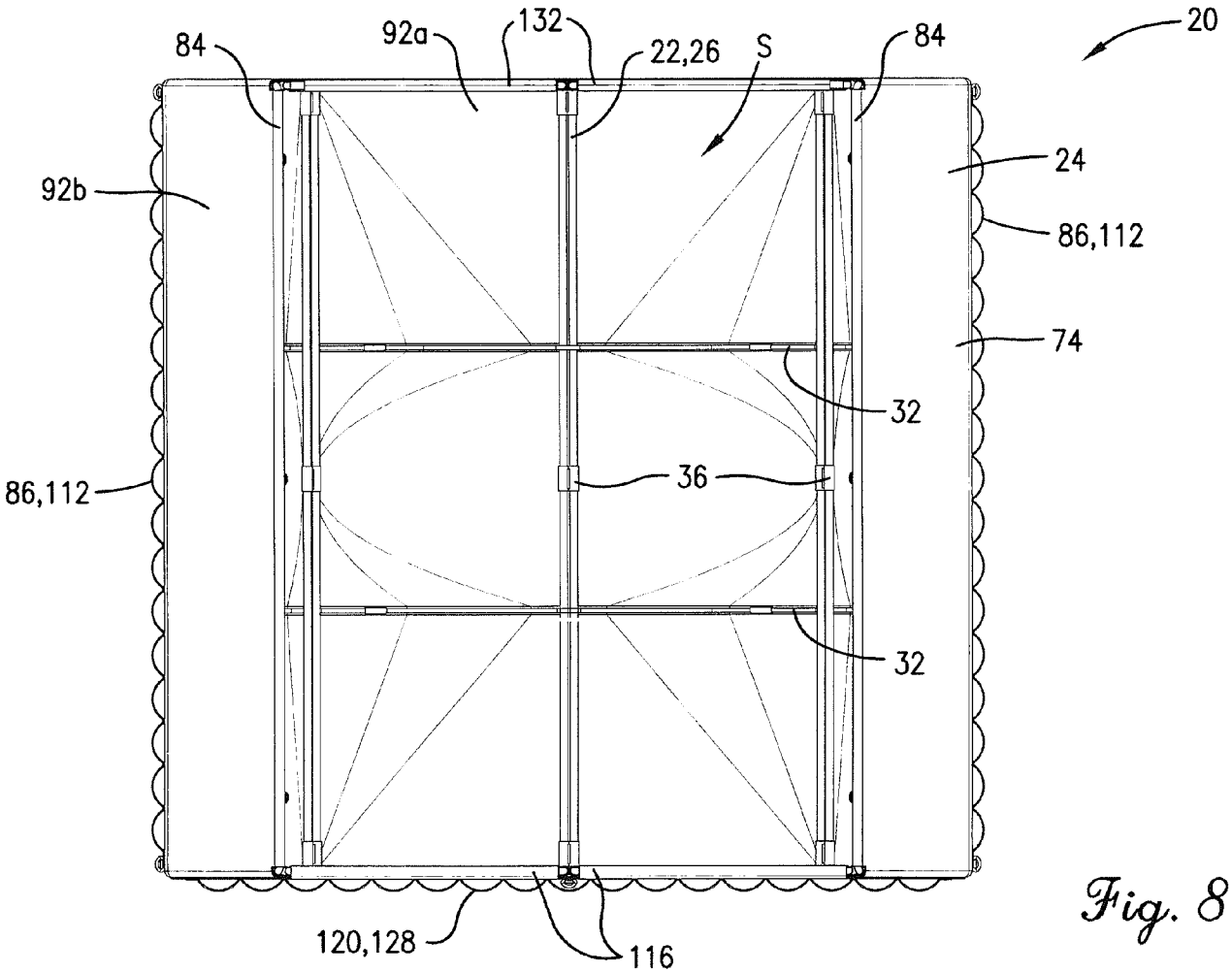
Figure 9A:
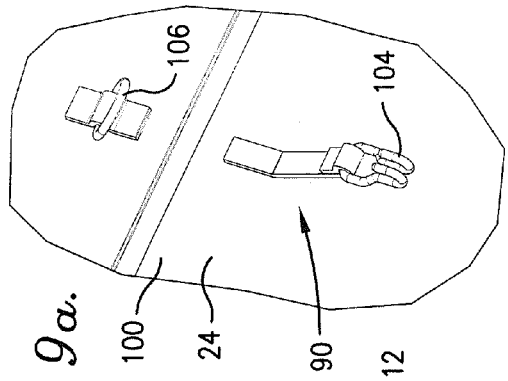
Figure 9B:
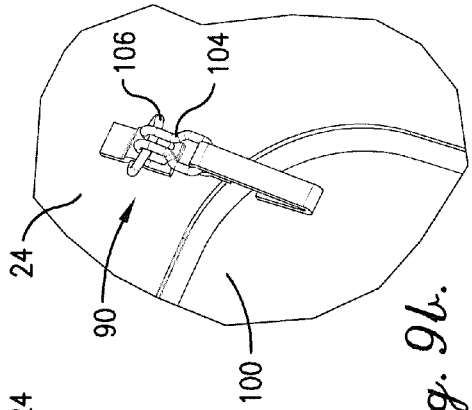
Figure 9:
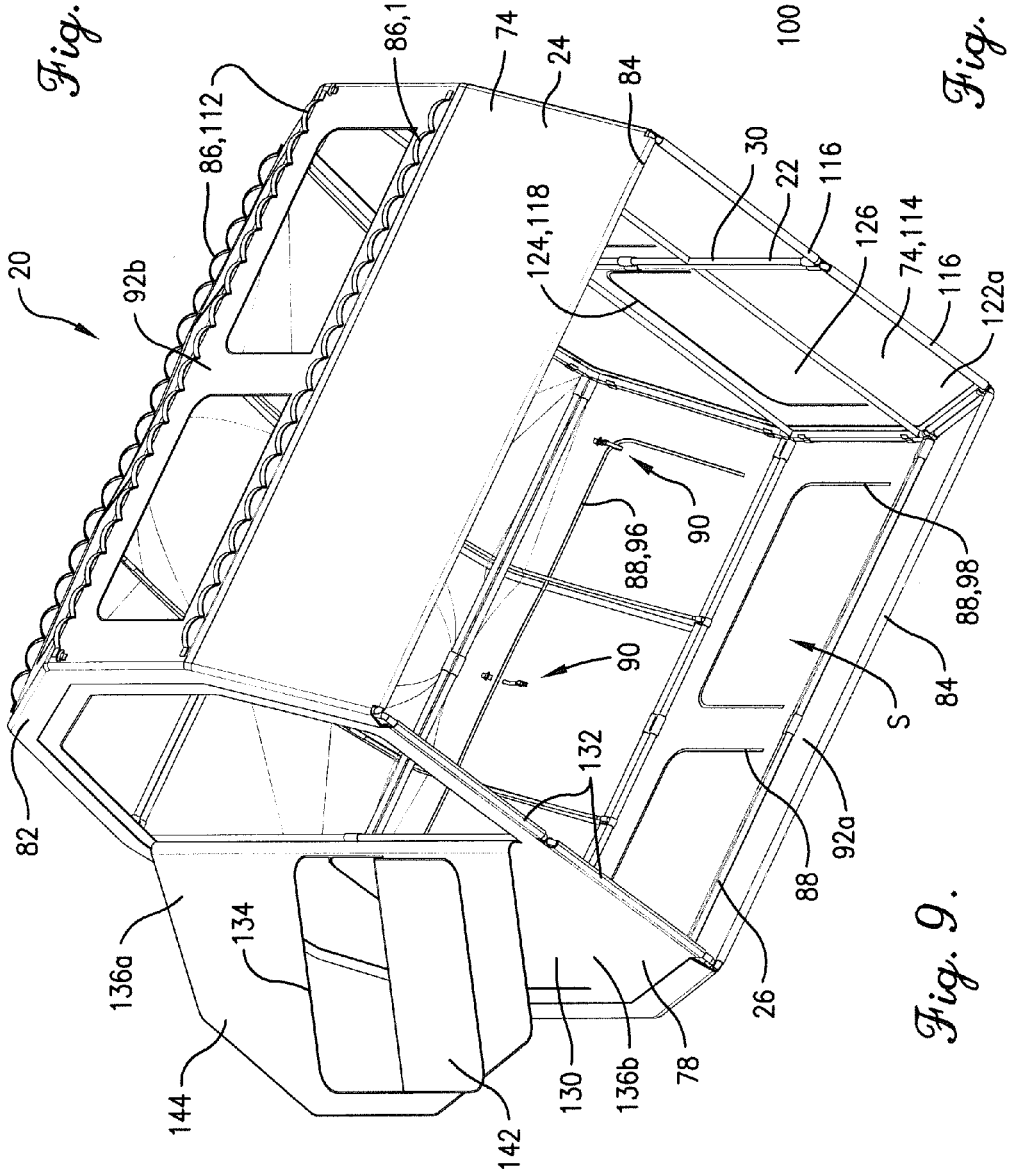
Figure 10:
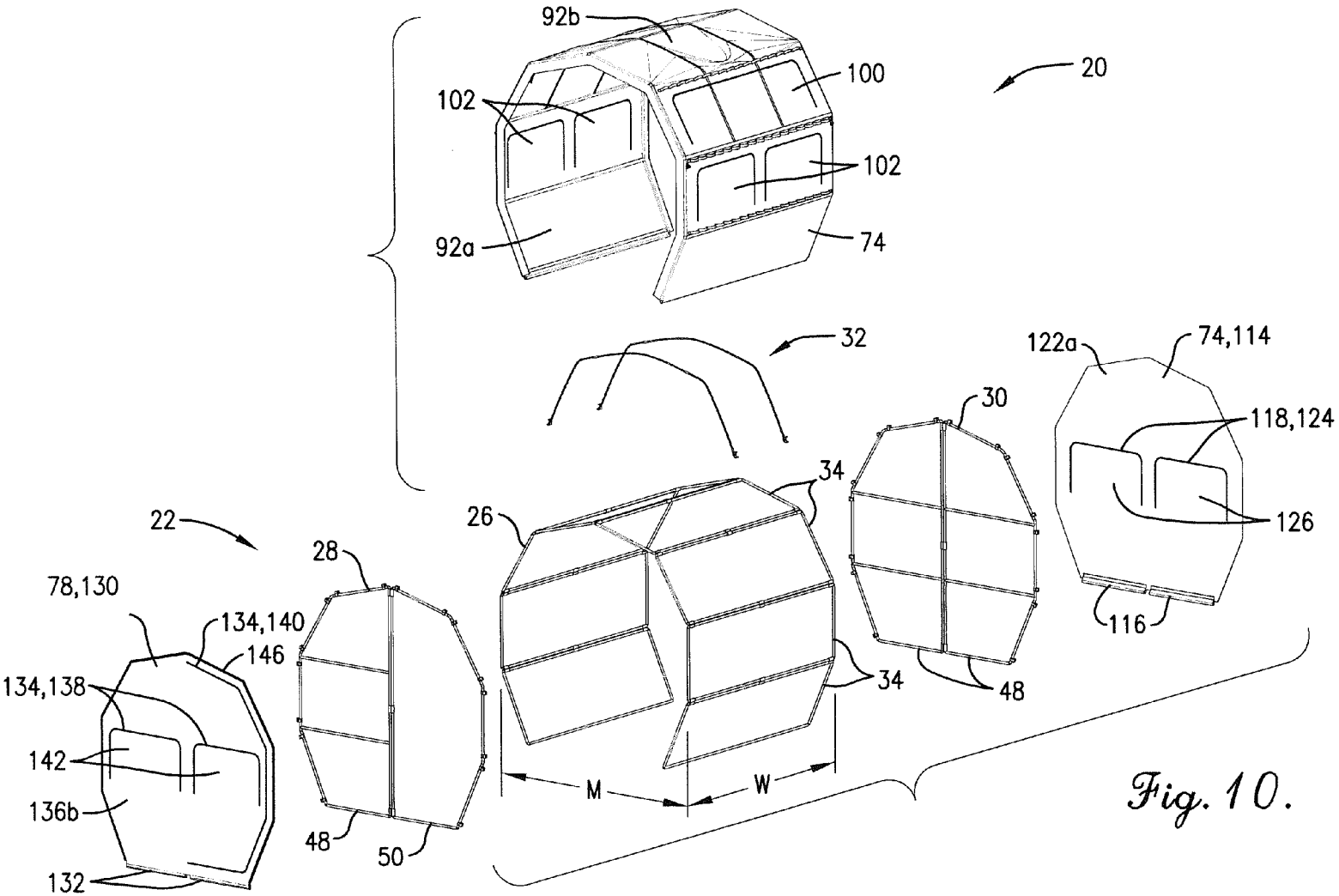
Figure 11:
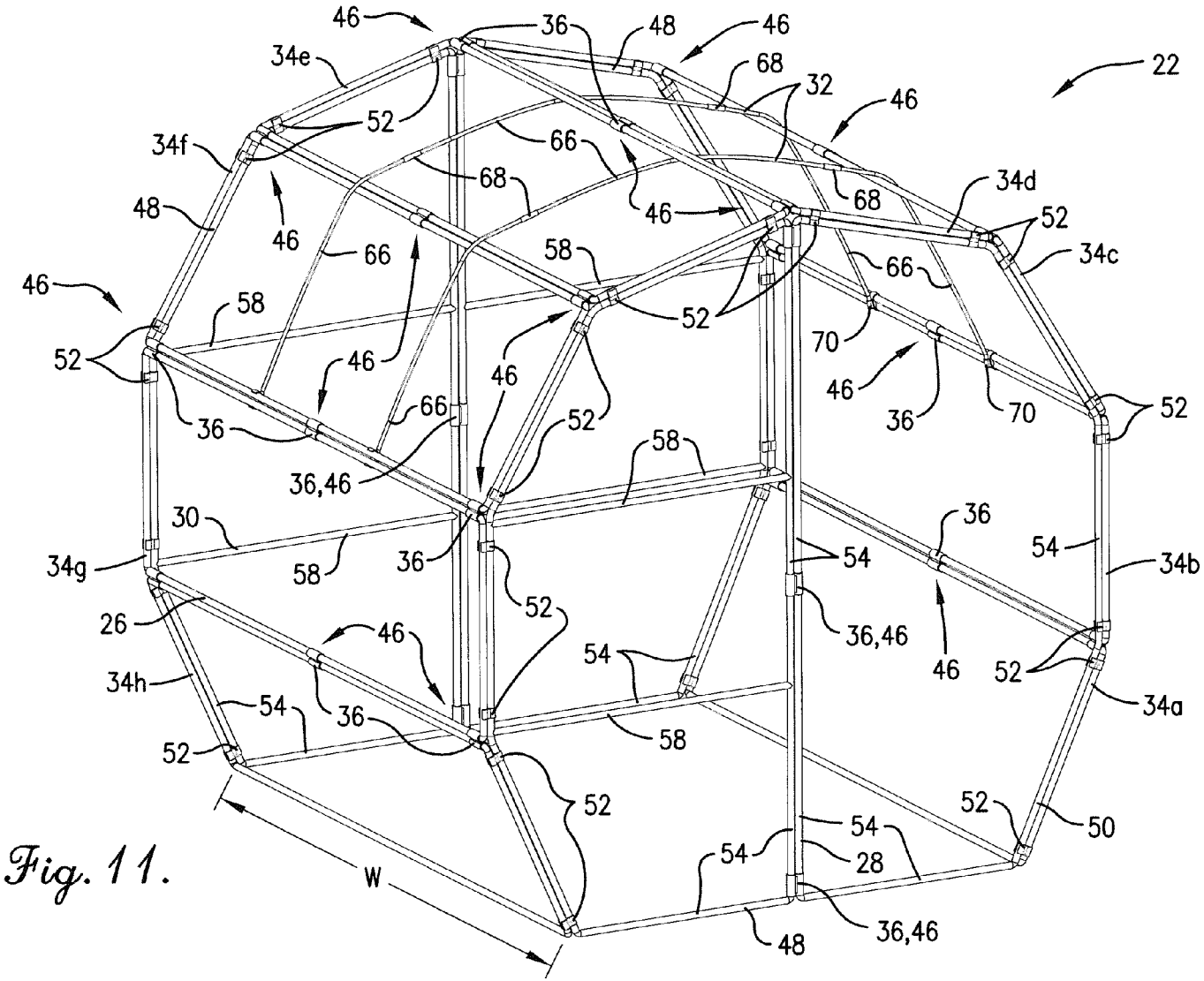
Figure 12:
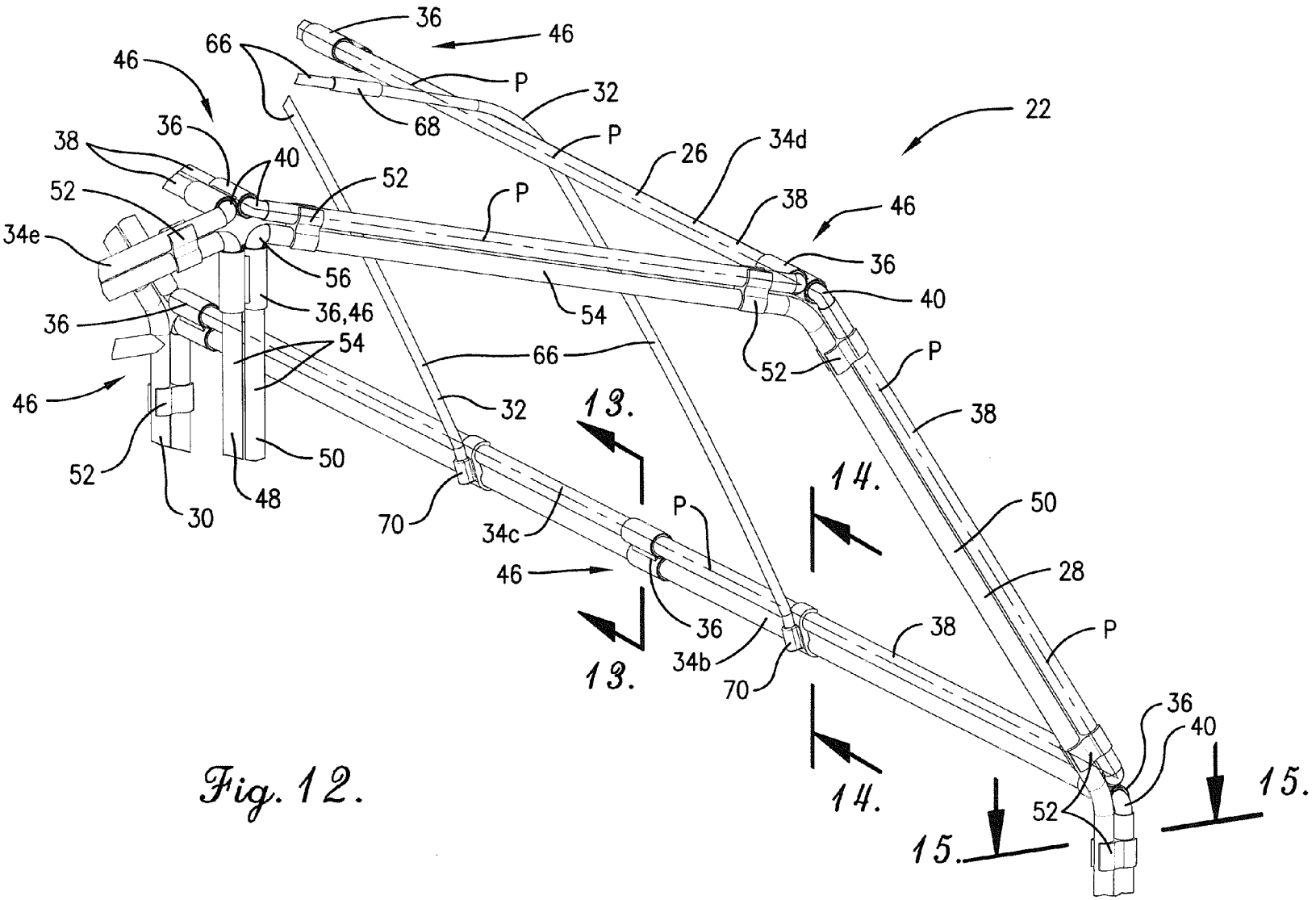
Figure 13:
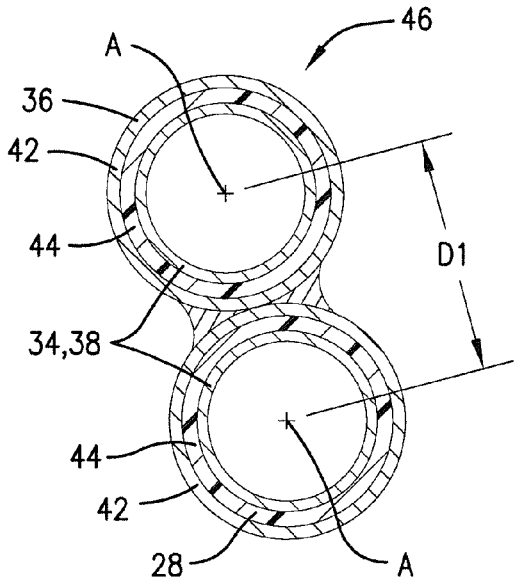
Figure 14:
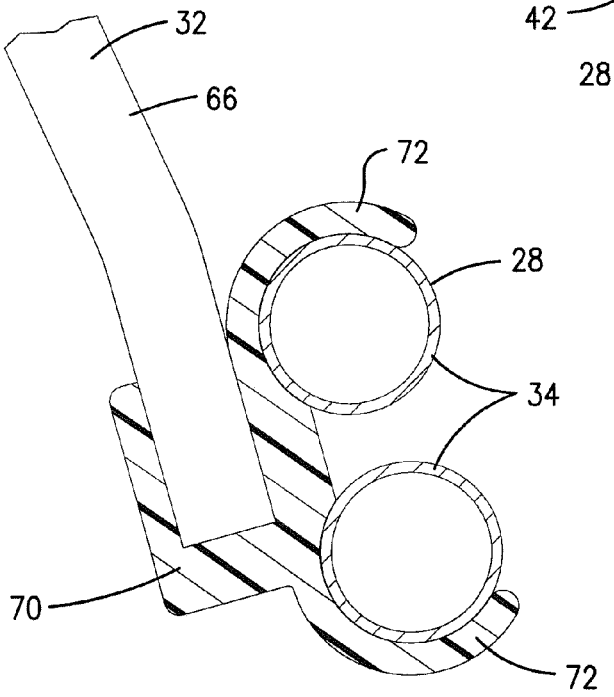
Figure 15:
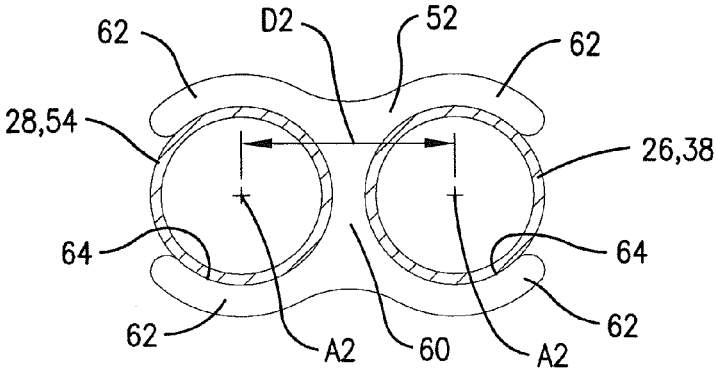
Figure 16:
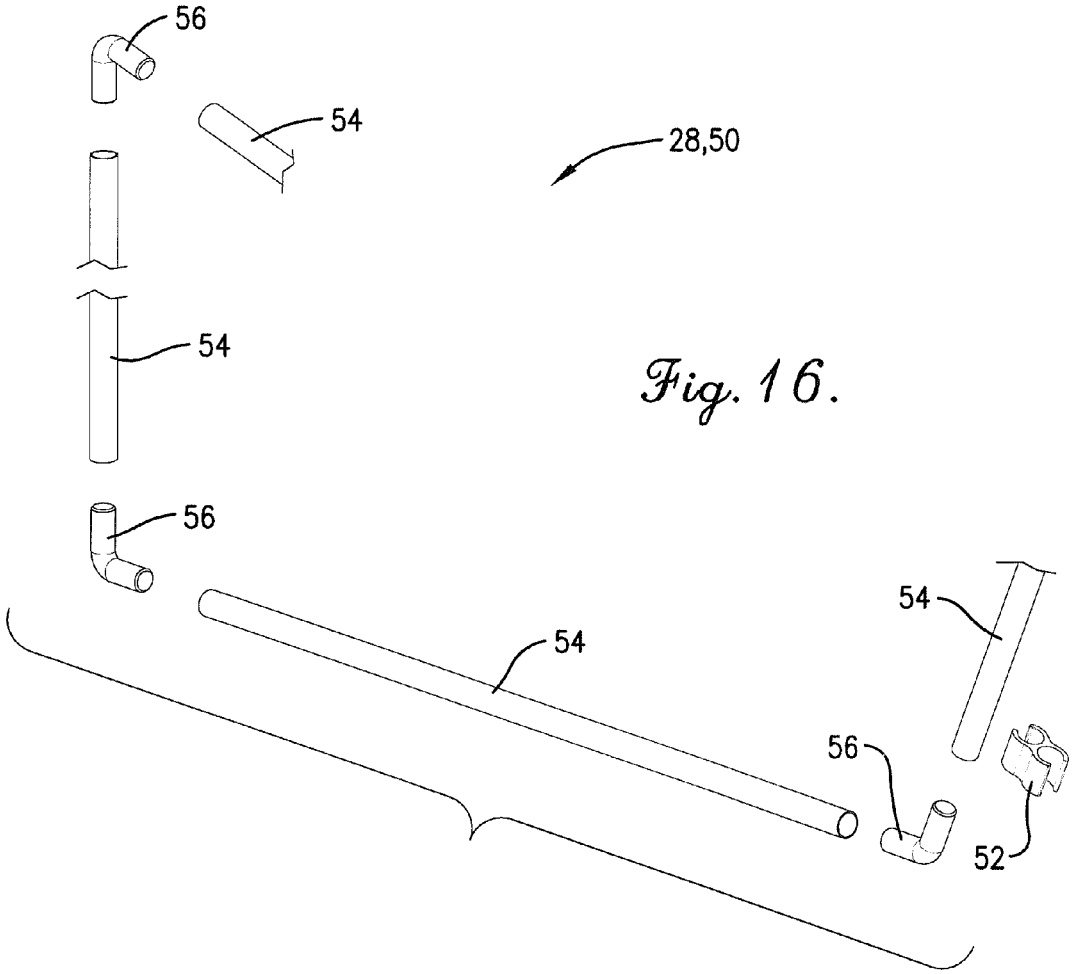
Figure 17:
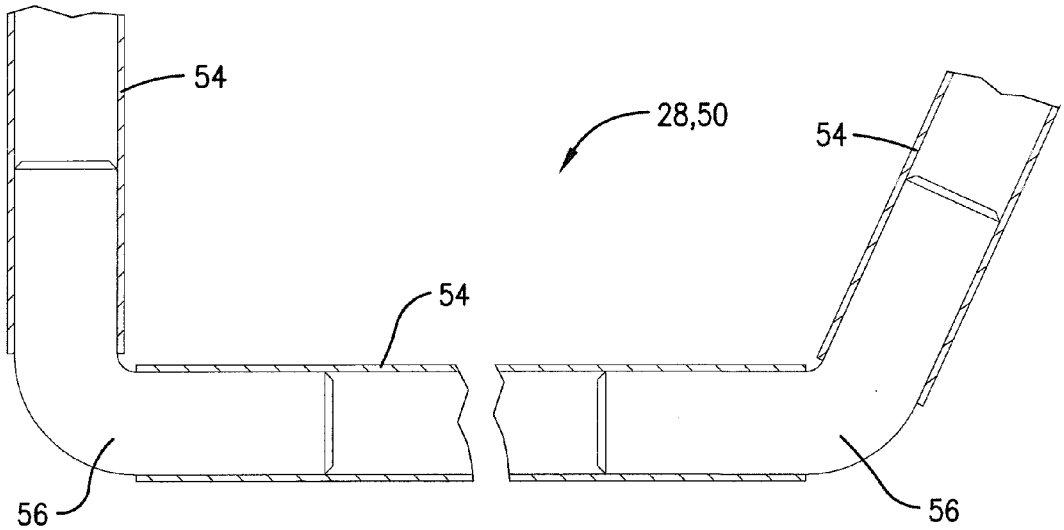
Figure 18:
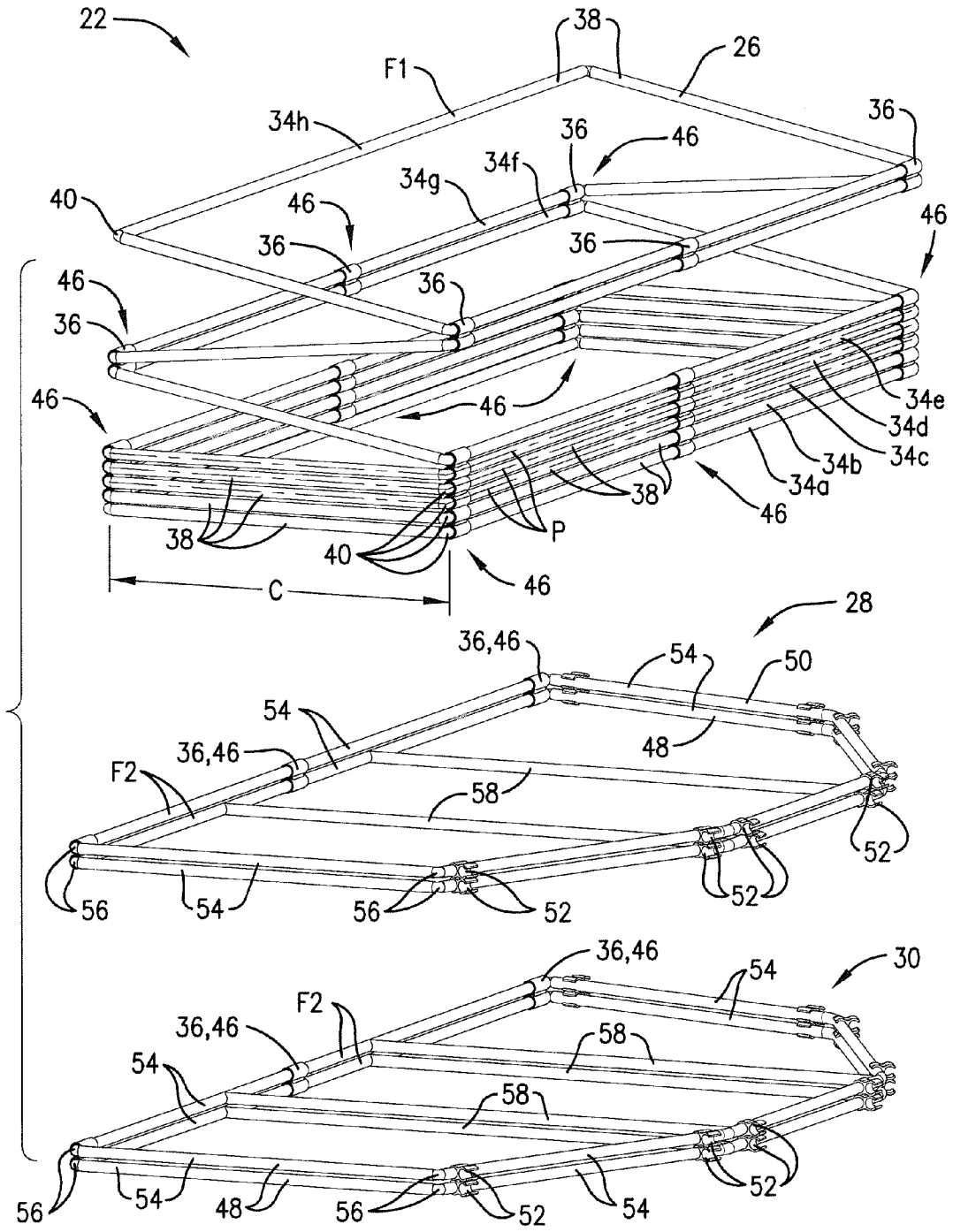
Figure 19:
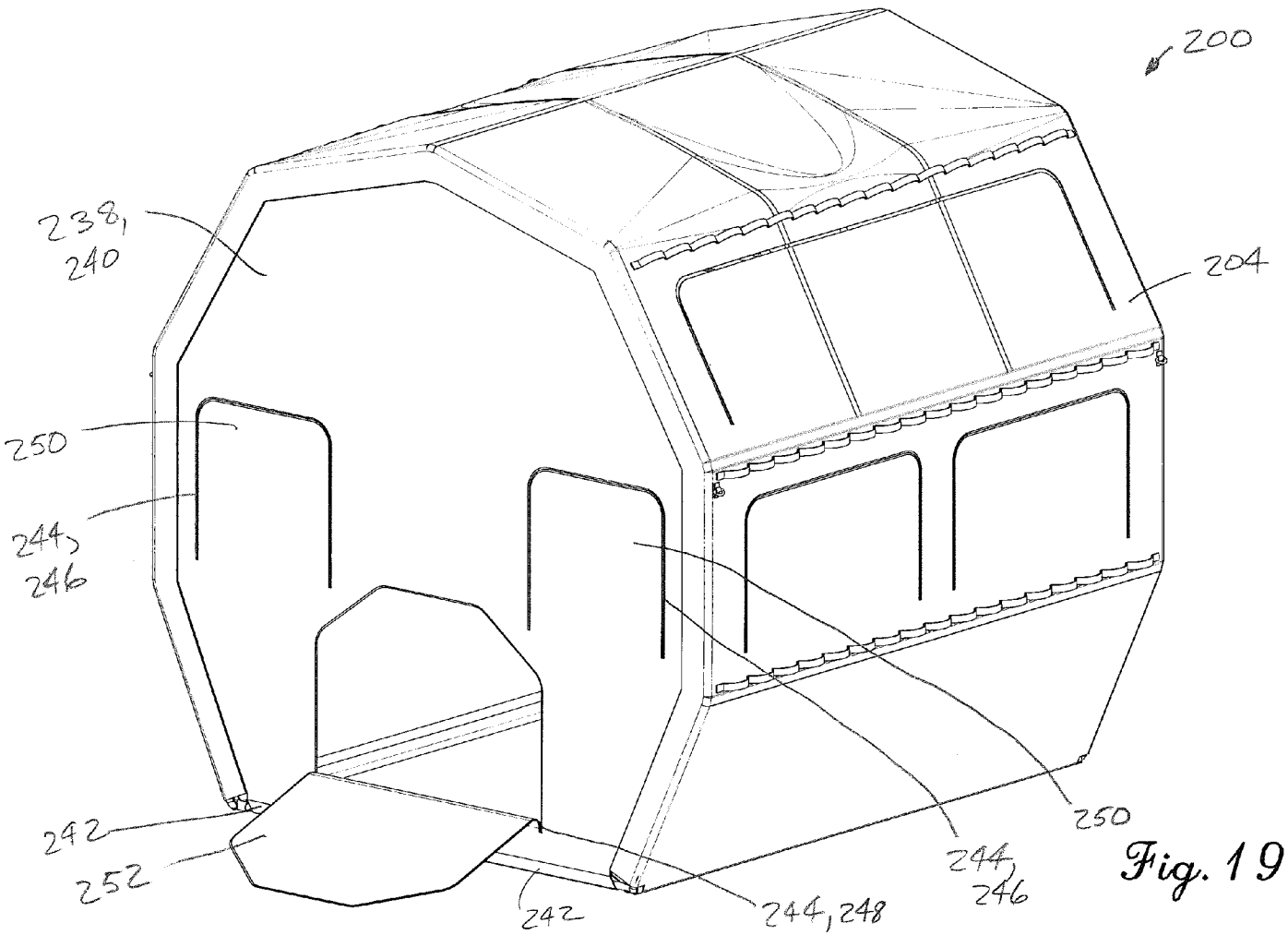
Figure 20:
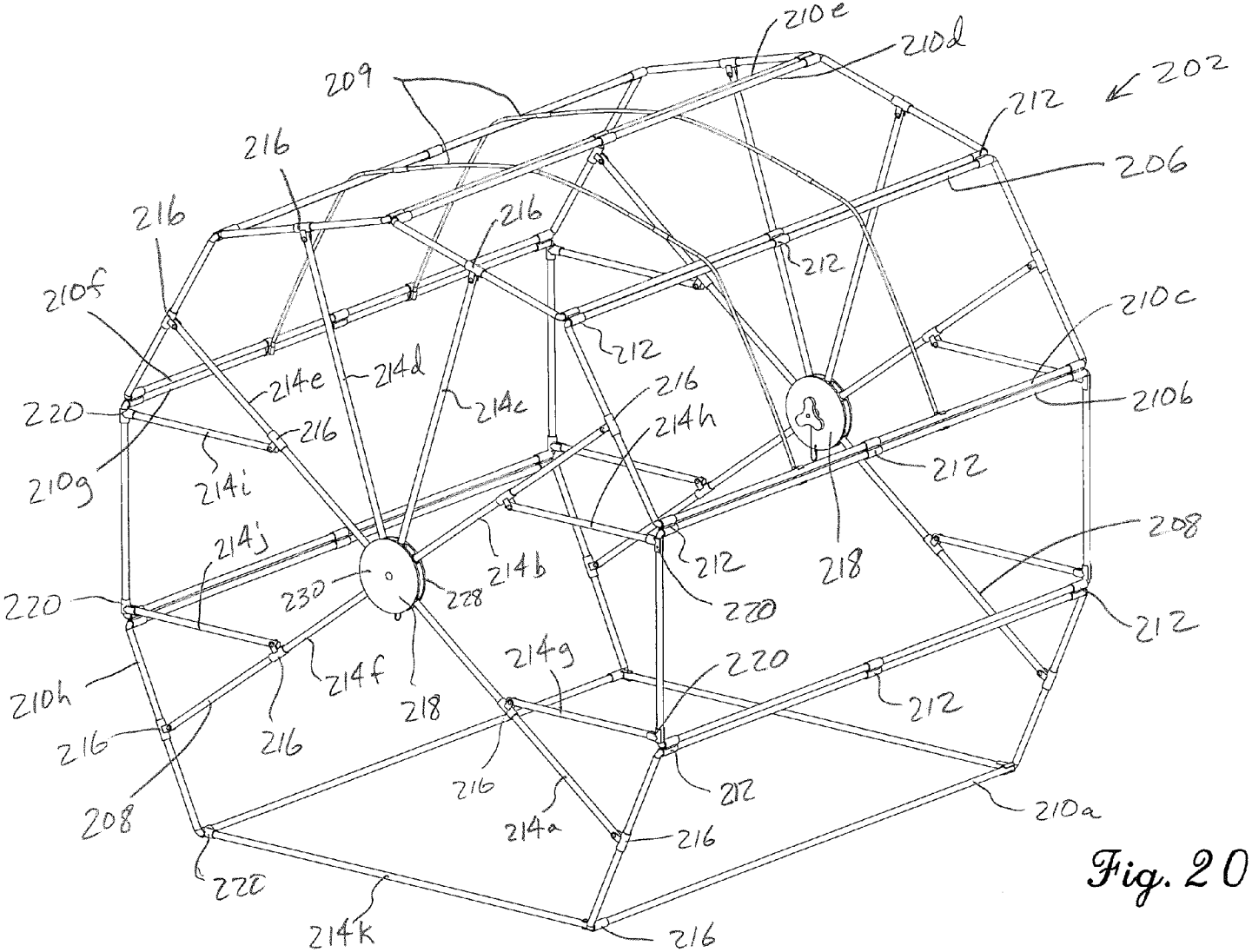
Figure 21:
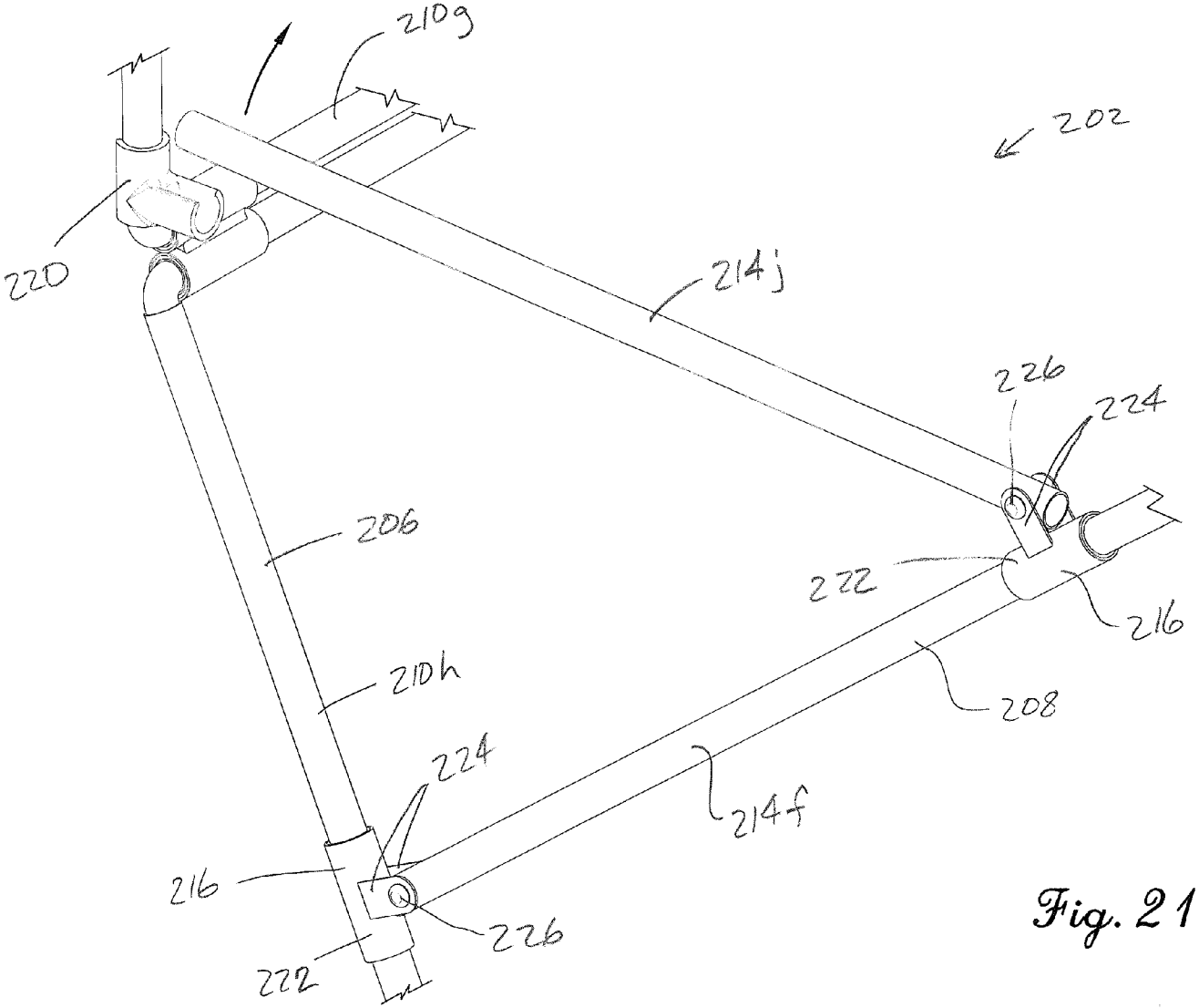
Figure 22:
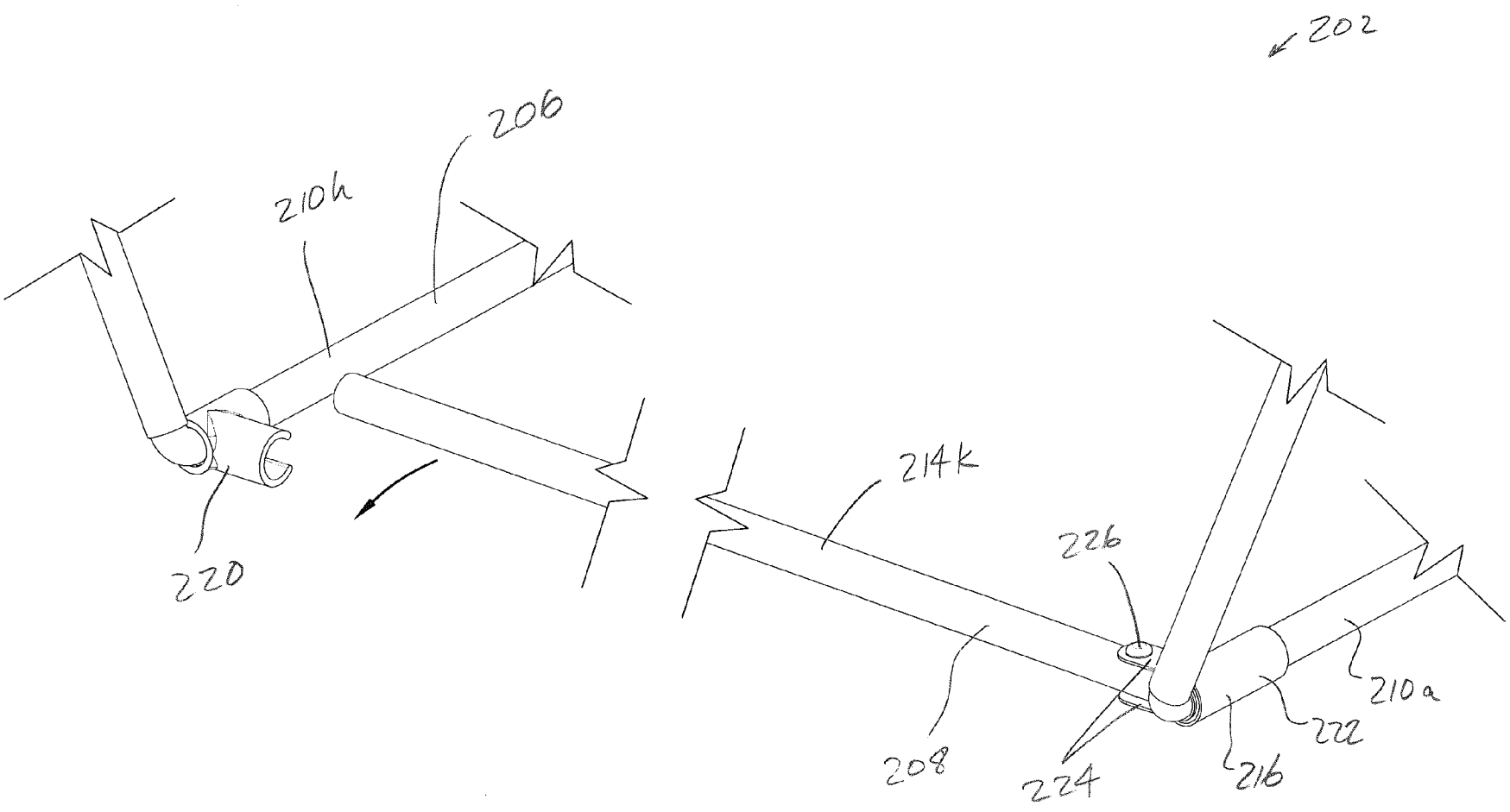
Figure 23:
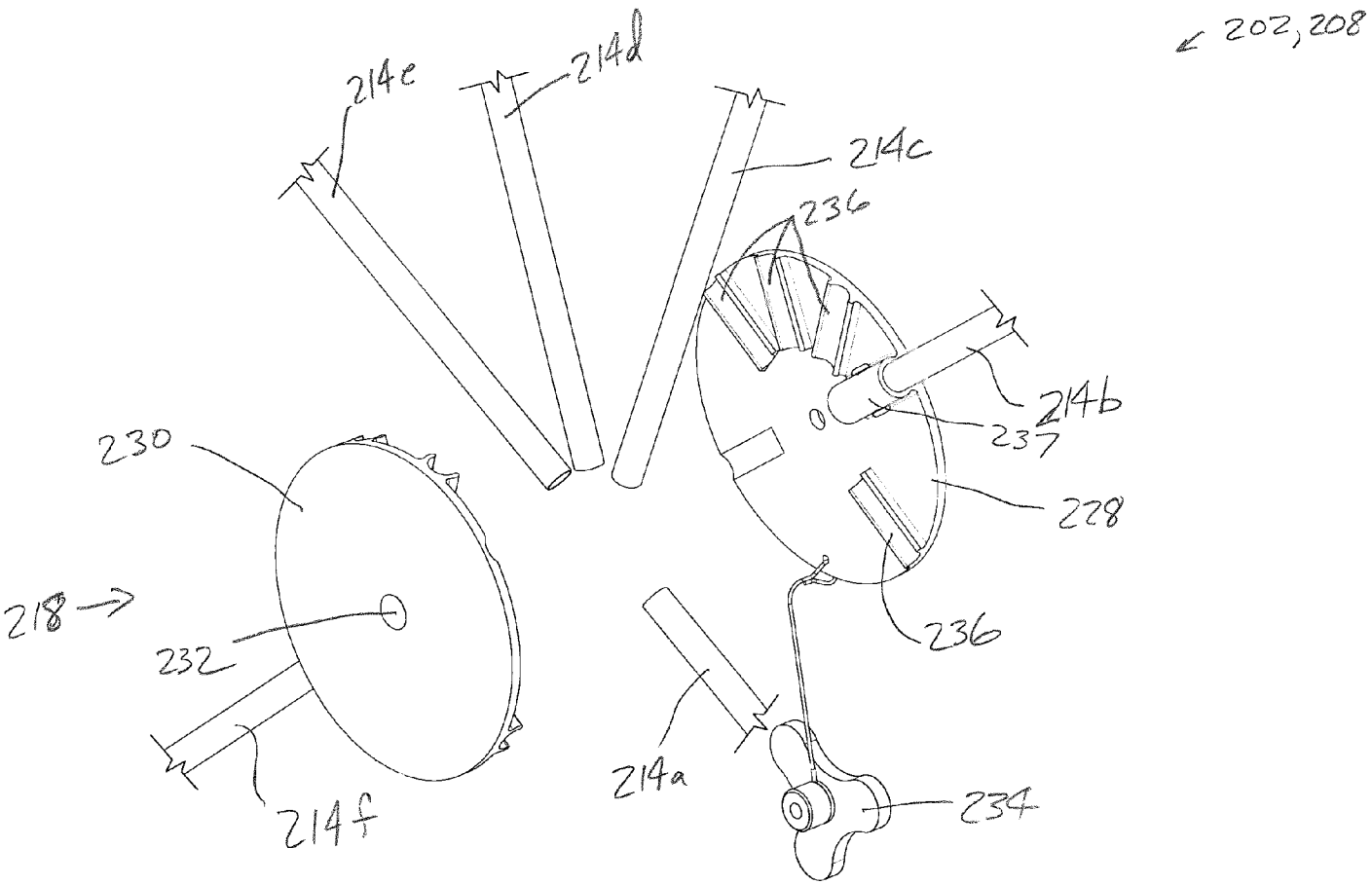
Figure 24:
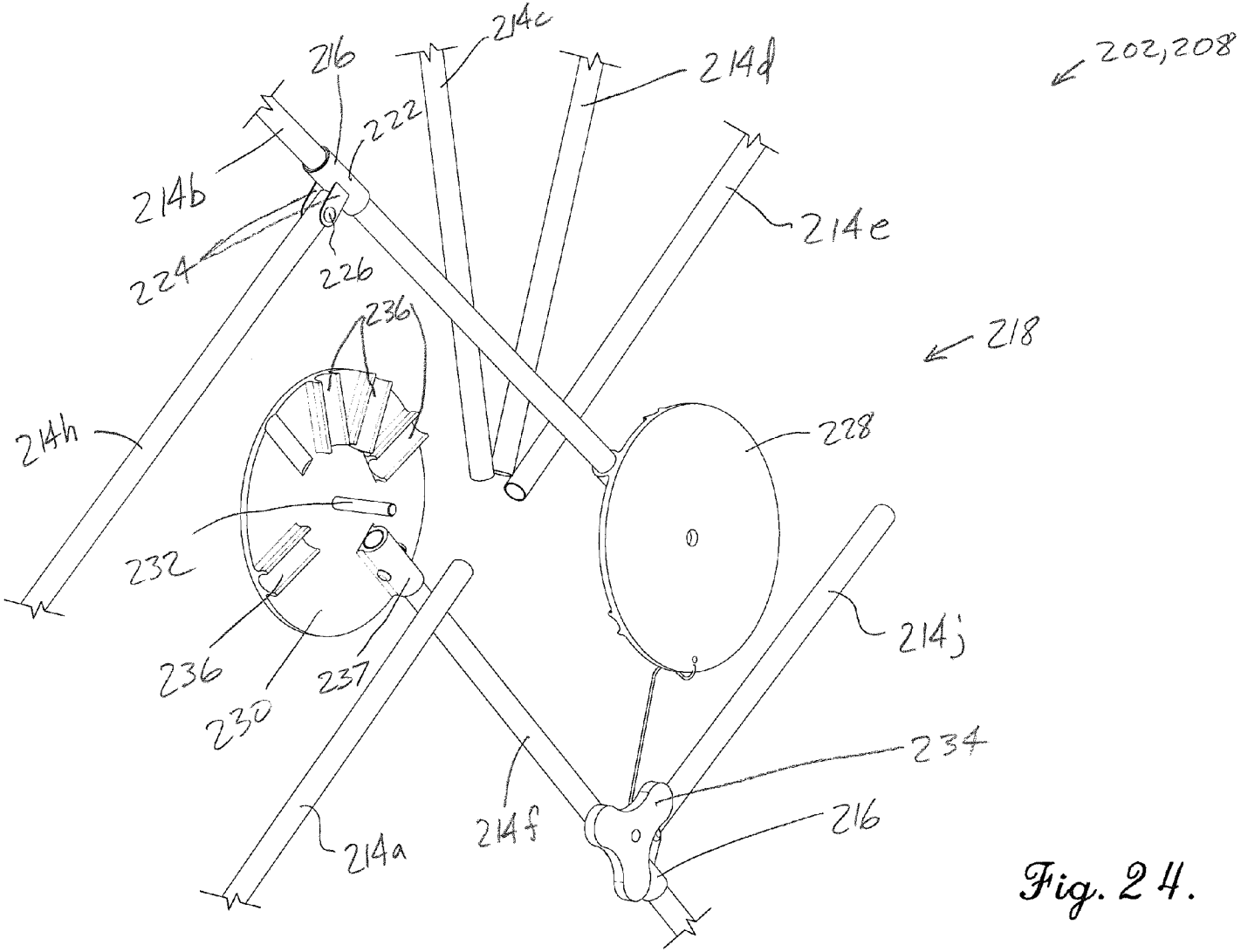

FIG. 3*a* is a fragmentary cross section of the ground blind taken along line 3*a*-3*a* in FIG. 3;

FIG. 4 is a front elevation of the ground blind shown in FIGS. 1-3, showing the door and flaps of the front end cover in the closed position;

FIG. 5 is a left side elevation of the ground blind shown in FIGS. 1-4;

FIG. 6 is a rear elevation of the ground blind shown in FIGS. 1-5;

FIG. 7 is a top view of the ground blind shown in FIGS. 1-6;

FIG. 8 is a bottom view of the ground blind shown in FIGS. 1-7;

FIG. 9 is a lower perspective of the ground blind shown in FIGS. 1-8, showing parts of the frame assembly and the interior of the ground blind, and showing one of the flaps along the central section being associated with hook assemblies attached along the interior surface of the central section, with one of the hook assemblies being connected and another one of the hook assemblies being disconnected;

FIG. 9*a* is an enlarged fragmentary perspective of the ground blind shown in FIG. 9, showing the disconnected hook assembly;

FIG. 9*b* is an enlarged fragmentary perspective of the ground blind shown in FIG. 9, showing the connected hook assembly;

FIG. 10 is a fragmentary exploded perspective of the ground blind shown in FIGS. 1-9*b*, showing the frame assembly including an articulated frame, front and back end frames, and rods;

FIG. 11 is a front perspective of the frame assembly shown in FIG. 10, showing sections of the articulated frame interconnected with hinge devices, and showing sections of the end frames interconnected with hinge devices, with the articulated frame and end frames being attached to one another with connectors so that the frame assembly is erected, and with the rods being connected to the articulated frame;

FIG. 12 is an enlarged fragmentary perspective of the frame assembly shown in FIGS. 10 and 11, showing connectors used to interconnect the articulated frame and the front end frame;

FIG. 13 is a cross section of the frame assembly taken along line 13-13 in FIG. 12 to show the adjacent frame sections and a hinge device that cooperatively form a hinge;

FIG. 14 is a cross section of the frame assembly taken along line 14-14 in FIG. 12; showing an end connector and rod segment of one of the rods attached to the articulated frame;

FIG. 15 is a cross section of the frame assembly taken along line 15-15 in FIG. 12; showing the articulated frame and front end frame attached to one another with one of the connectors;

FIG. 16 is a fragmentary exploded view of the front end frame shown in FIGS. 11 and 12, showing peripheral tubes and tube connectors of the front end frame and a connector;

FIG. 17 is a fragmentary front elevation of the front end frame shown in FIGS. 11, 12, and 16, showing the peripheral tubes and tube connectors fixed to one another;

FIG. 18 is a perspective of the frame assembly shown in FIGS. 10-17, showing the articulated frame and end frames collapsed and separated from one another;

FIG. 19 is a front perspective of a ground blind constructed in accordance with a second embodiment of the present invention, with the ground blind including a frame assembly and a cover assembly, and with the frame assembly including an articulated frame and end frame assemblies;

FIG. 20 is a fragmentary front perspective of the ground blind similar to FIG. 19, but with the cover assembly being removed to depict the frame assembly;

FIG. 21 is an enlarged fragmentary perspective of the frame assembly shown in FIGS. 19 and 20, showing end rods of the end frame assembly;

FIG. 22 is an enlarged fragmentary perspective of the frame assembly shown in FIGS. 19-21, showing a lowermost end rod of the end frame assembly;

FIG. 23 is an enlarged fragmentary front perspective of the frame assembly shown in FIGS. 19-22, showing a hub assembly of the frame assembly, with end rods positioned adjacent the hub assembly for attachment thereto; and FIG. 24 is an enlarged fragmentary rear perspective of the frame assembly shown in FIGS. 19-23.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIGS. 1-3, a ground blind 20 is constructed in accordance with a preferred embodiment of the present invention. The ground blind 20 preferably provides a semi-permanent camouflaged enclosure for one or more hunters. By referring to the ground blind 20 as semi-permanent, it will be understood that the ground blind 20 is preferably operable to be setup in an erected configuration or taken down and placed in a collapsed configuration in a matter of minutes by one or two hunters, as will be discussed further. In this manner, the ground blind 20 resists excessive wind, rain, or snow while being relatively portable.

The ground blind 20 is preferably used as a camouflaged shelter by hunters. For instance, the ground blind 20 could be used to hunt deer, turkey, or geese. To this end, the cover of the blind 20 presents an exterior surface with conventional camouflage graphics (not shown). Additionally, the ground blind 20 also preferably has a generally cylindrical shape so that the blind is sized and shaped to resemble the size and shape of a conventional round hay bale. Thus, with camouflage graphics resembling hay, the blind looks similar to a round hay bale. The illustrated blind 20 is preferably secured to the ground with an anchoring assembly including a plurality of conventional lines L and anchors An, although other anchoring structures could be used, e.g., depending upon the size and shape of the blind 20.

One of ordinary skill in the art will appreciate that the cover could have alternative graphics, such as alternative camouflage graphics suited for blending in with the adjacent environment, without departing from the scope of the present invention. While the blind 20 preferably has the cylindrical shape when erected, it is within the ambit of the present invention where the blind 20 has an alternative shape. Again, the blind 20 is preferred for use as a camouflaged shelter. However, it will appreciated that the blind 20 could have various other uses as an enclosure or shelter. For instance, the blind 20 could be used to provide an enclosure for covered storage. The blind 20 broadly includes a frame assembly 22 and a cover assembly 24.

Turning to FIGS. 10-18, the illustrated frame assembly 22 is a preferred support structure for blind 20. The frame assembly 22 preferably includes an articulated frame 26, front and back end frames 28,30, and a pair of elongated upper support rods 32. As will be discussed in greater detail, the articulated frame 26 is efficiently shiftable between erected and collapsed configurations. The articulated frame 26 preferably includes a plurality of tubular frame sections 34*a-h* and hinge devices 36 that interconnect adjacent pairs of the frame sections 34.

The tubular frame sections 34 each preferably include metal peripheral tubes 38 and metal tube connectors 40 (see FIGS. 12 and 18). The tube connectors 40 preferably are made of solid metal rod with opposite ends that project from a bend. Each pair of adjacent tubes 38 and the respective tube connector 40 are preferably welded to each other so that the frame section 34 is substantially rigid and unitary. The tubes 38 are preferably made from one-half inch nominal diameter steel tubing, although other tubing sizes could be used without departing from the scope of the present invention. While the tubes 38 and tube connectors 40 are preferably metal, the principles of the present invention are applicable where the tubes 38 and tube connectors 40 are made from other materials, such as a synthetic resin material. The articulated frame 26 preferably has a wear-resistant outer coating, such as a powder-coated finish or similar baked finish.

The illustrated tubular frame sections 34 each preferably have the peripheral tubes 38 arranged in a generally rectangular shape having a section width dimension W, with the peripheral tubes 38 and tube connectors 40 defining a continuous outer margin of a framed area F1 (see FIGS. 11 and 18). However, as will be explained in greater detail, the frame sections 34 could be alternatively shaped to provide the frame assembly 22 without departing from the scope of the present invention. For instance, one or more frame sections 34 could have different width dimensions W and/or could have different values of framed area F1.

Turning to FIG. 13, the hinge devices 36 each preferably include a pair of sleeves 42 fixed alongside one another so that the sleeves 42 present axes A that are substantially parallel to one another. As will be discussed, the sleeves 42 are preferably fixed so that the axes A define a hinge spacing dimension D1 that is about equal to or greater than the diameter dimension of the peripheral tubes 38. Preferably, the sleeves 42 comprise metal tubes, with the sleeves 42 being welded to each other. The hinge devices 36 also preferably include a pair of bushings 44 that are inserted and frictionally secured within the sleeves 42. The bushings 44 are preferably made of nylon, but could include other materials, such as ultra-high-molecular-weight (UHMW) polyethylene, another type of synthetic resin, or a relatively soft metal such as brass. The bushings 44 each present a bore that rotatably receives a corresponding one of the frame sections 34. Preferably, the bushings 44 and respective tubes 38 rotatably and frictionally engage one another so that frictional engagement between the tube 38 and bushing 44 restricts relative rotation therebetween. In this manner, each hinge device 36 interconnects a respective pair of adjacent frame sections 34 and serves to restrict relative rotation between the frame sections 34.

Turning to FIGS. 10-15 and 18, each pair of adjacent frame sections 34 is preferably interconnected by three of the hinge devices 36 so that the adjacent frame sections 34 and each hinge device 36 cooperatively form a pair of parallel hinges 46 that provide pivot joints permitting relative rotation about the parallel sleeve axes A. Of course, it will be appreciated that an alternative number of hinge devices 36 could be employed to provide suitable interconnection of the adjacent frame sections 34. Also, while the hinges 46 provide preferred pivot joints, the principles of the present invention are applicable where the pivot joints connecting each pair of adjacent frame sections 34 have an alternative construction.

Again, the sleeves 42 are preferably fixed so that the axes A define a hinge spacing dimension D1 that is about equal to or greater than the diameter dimension of the metal tubes. In this manner, adjacent frame sections 34 can preferably be shifted into and out of a folded position where the framed areas F1 of the adjacent frame sections 34 are positioned adjacent one another (see FIG. 18). Each frame section 34 preferably defines a plane P that extends through the longitudinal axes of the associated tubes 38. Preferably, the frame sections 34 and hinge devices 36 are constructed so that the planes P of adjacent frame sections 34 are substantially parallel with one another in the folded position (see FIGS. 12 and 18). However, for some aspects of the present invention, the planes P could define a slightly oblique angle in the folded position.

As will be discussed, the articulated frame 26 is preferably configured so that the hinge devices 36 allow the articulated frame 26 to assume a very compact shape in the collapsed configuration, as will be explained below. In the erected configuration, the articulated frame 26 preferably provides support for the top and opposite sides of the blind 20 and defines the shape of a covered interior space S.

Turning again to FIGS. 10-18, the end frames 28,30 preferably include tubular end frame sections 48,50, hinge devices 36 that interconnect the end frame sections 48,50, and connectors 52. The end frames 28,30 are also shiftable between erected and collapsed configurations.

Similar to frame sections 34, end frame sections 48,50 each preferably include metal peripheral tubes 54 and metal tube connectors 56. The end frame sections 48 also preferably include metal intermediate tubes 58 that extend laterally to be fixed to and thereby interconnect opposite peripheral tubes 54 (see FIG. 11). The end frame section 50 preferably does not include metal intermediate tubes so that the end frame section can accommodate a door for ingress and egress relative to the blind 20.

Again, the tube connectors 56 preferably are made of solid metal rod with opposite ends that project from a bend. The tubes 58 are preferably made from one-half inch nominal diameter steel tubing, although other tubing sizes could be used without departing from the scope of the present invention. Each pair of adjacent peripheral tubes 54 and the respective tube connector 56 are preferably welded to each other so that the frame section 48,50 is substantially rigid and unitary, although the tubes 54 and tube connectors 56 could be made from other materials, such as a synthetic resin material. The end frames 28,30 also preferably have a wear-resistant outer coating, such as a powder-coated finish or similar baked-on finish.

The end frame sections 48,50 preferably have the illustrated six-sided shape formed by peripheral tubes 54 that define a continuous outer margin of a framed area F2 (see FIG. 18). However, the end frame sections 48,50 could be alternatively shaped to provide the end frames 28,30 without departing from the scope of the present invention.

Each pair of end frame sections 48,50 is preferably interconnected by three of the hinge devices 36 so that the adjacent frame sections 48,50 and each hinge device 36 cooperatively form a pair of parallel hinges 46 that permit relative rotation about the parallel sleeve axes A. Of course, it will be appreciated that an alternative number of hinge devices 36 could be employed to provide suitable interconnection of the adjacent frame sections 48,50.

Turning to FIGS. 12 and 15, each connector 52 is preferably a unitary clamp and includes a central body 60 and opposite pairs of tabs 62 that present open ends of the connector 52. The tabs 62 can flex relative to the body 60, with the connector 52 presenting parallel bores 64. The bores 64 have axes A2 that are parallel and are positioned apart to define an opening spacing dimension D2. In the illustrated embodiment, the opening spacing dimension D2 is substantially the same as the hinge spacing dimension D1, although the opening spacing dimension D2 could be alternatively sized. The connectors 52 are preferably removably attached to the respective end frame section 48,50, with the tabs 62 of connectors 52 grabbing and holding the respective end frame section. However, it is within the scope of the present invention where the connectors 52 are captive, i.e., permanently attached, on either the respective end frame section 48,50 or the articulated frame 26.

The illustrated end frames 28,30 are removably attached along respective sides of the articulated frame 26 with the connectors 52, with the tabs 62 of connectors 52 grabbing and holding the articulated frame 26 so that the frame assembly 22 resists flexing movement and is preferably self-supporting. The frames 26,28,30 are preferably removably attached to one another with connectors 52 that provide tool-less connections. Thus, the frame assembly 22 can preferably be shifted between the collapsed and erected configurations without the use of tools. While the end frames 28,30 are preferably removably attached to articulated frame 26, a permanently-attached end frame structure, such as that shown in a subsequent embodiment, could be permanently attached to the articulated frame 26 without departing from the scope of the present invention.

Turning to FIGS. 11, 12, and 14, the rods 32 each include multiple elongated rod segments 66 that each comprise a flexible tube that flexes elastically when attached to the frame. Preferably, the rod segments 66 comprises fiberglass tubes, although the rod segments 66 could include other materials without departing from the scope of the present invention. The rods 32 also include sleeves 68 and an elongated elastic cord (not shown). Each pair of adjacent rod segments 66 are removably interconnected by one of the sleeves 68 when the rod 32 is assembled. The cord is preferably attached to opposite ends of the rod 32 and extends the length of the rod 32 through the rod segments 66 and sleeves 68. Also, the cord is preferably under tension when the rod 32 is assembled to urge the pairs of adjacent rod segments 66 to remain interconnected.

The rods 32 further include a pair of metal end connectors 70 that present opposite tabs 72. The end connectors 70 are attached to opposite ends of the rod 32, with the tabs 72 serving to grab a respective pair of frame tubes. The rods 32 are attached to and extend along the length of the articulated frame 26 to interconnect multiple frame sections 34. In particular, the rods 32 preferably extend along frame sections 34*c,d,e,f* to support the cover assembly 24 along the top of the blind 20 (see FIG. 11). The rods 32 extend along a curved path that extends at least partly out of planes P of the frame sections 34*c,d,e,f* so that the rods 32 resist sagging of the top of the main cover 74. It will be appreciated that the rods 32 could have an alternative length so as to extend along more or less of the frame sections 34 without departing from the scope of the present invention.

Turning to FIGS. 1-10, the cover assembly 24 preferably provides a weather resistant cover for the frame assembly 22 so that the blind 20 presents the covered interior space S. The cover assembly 24 preferably includes a main cover 74, a fixed end cover 76, and a removable end cover 78, with the end covers 76,78 being attached to the main cover 74, as will be discussed. The main cover 74 includes an elongated central section 80, side and end margins 82,84, fabric strips 86, zippers 88 (shown schematically), and fabric hook assemblies 90. The central section 80 extends continuously between opposite end margins 84 and comprises a fabric sheet that presents interior and exterior surfaces 92*a,b*. The central section 80 also presents multiple slots 96,98 that define movable flaps 100,102.

The zippers 88 are conventional and are attached to the central section 80 along the slots 96,98 so that the flaps 100,102 can be selectively opened and closed. While the zippers 88 are preferred, it is within the ambit of the present where an alternative fastener arrangement is used to hold each flap 100,102 open or closed along the length of the respective slot 96,98.

The fabric hook assemblies 90 each include a hook 104 and a loop 106 (see FIGS. 9*a* and 9*b*). The hooks 104 are attached to flaps 100 and the loops 106 are attached to the central section 80 on the other side of slots 96. Thus, the hooks 104 can be removably connected to corresponding loops 106 to selectively hold the flap 100 upright. Alternatively, the hook assemblies 90 can be selectively disconnected to permit the flap 100 to drop into a hanging position.

Again, the main cover 74 includes side margins 82 and end margins 84. The end margins 84 preferably include elongated hook and loop fasteners 108,110 sewn onto the fabric at spaced apart positions along the end margins 84 (see FIG. 3*a*). The fasteners 108,110 are removably attached to one another so that the end margins 84 are each formed into a loop.

The fabric strips 86 are attached to the exterior surface 92*b* of the central section and extend laterally. The strips 86 are preferably sewn onto the central section 80 to form a plurality of laterally spaced loops 112 that provide brush connectors operable to receive and hold pieces of brush.

The fixed end cover 76 preferably includes a unitary main section 114, bottom sections 116, zippers 118, and fabric strips 120 (see FIG. 2). The main section 114 preferably comprises a fabric sheet that presents interior and exterior surfaces 122*a,b*, a continuous outer margin, and slots 124 that define movable flaps 126.

The bottom sections 116 are mounted along the bottom margin of the main section 114 and preferably include elongated hook and loop fasteners (not shown). The fasteners are sewn along the bottom margin and are removably attached to one another so that the bottom sections 116 form a loop.

The zippers 118 are conventional and are attached to the main section 114 along the slots 124 so that the flaps 126 can be selectively opened and closed. While the zippers 118 are preferred, it is within the ambit of the present where an alternative fastener is used to hold each flap 126 open or closed along the length of the respective slot 124.

The fabric strips 120 are attached to the exterior surface 122*b* of the main section 114 and extend laterally. The strips 120 are preferably sewn onto the main section to form a plurality of laterally spaced loops 128 that provide brush connectors operable to receive and hold pieces of brush.

The fixed end cover 76 is preferably sewn to the main cover 74 with a continuous line of stitches along the side of the main cover. However, the principles of the present invention are applicable where the end cover 76 and main cover 74 are fixed to each other with alternative fasteners. Also, while the end cover 76 is preferably fixed to the main cover 74, it is within the ambit of the present invention where end cover 76 is also removable such that both end covers 76,78 can be selectively attached to and removed from the main cover 74.

The combination of the main cover 74 and the fixed end cover 76 can be secured onto the frame assembly 22. In particular, the covers 74,76 are preferably positioned with the interior surfaces 93*a*,122*a* against corresponding portions of the frame. The end margins 84 are then folded around the ends of the articulated frame 26 so that the covers 74,76 are secured to the frame, preferably with the covers 74,76 being under some tension so as to conform along the planar shapes of the frame sections.

The removable end cover 78 preferably includes a unitary main section 130, bottom sections 132, and zippers 134. The main section 130 preferably comprises a fabric sheet that presents interior and exterior surfaces 136*a,b*, a continuous outer margin, and slots 138,140 that define movable flaps 142 and a door 144.

The bottom sections 132 are mounted along the bottom margin of the main section and preferably include elongated hook and loop fasteners (not shown). The fasteners are sewn along the bottom margin and are removably attached to one another so that the bottom sections 132 form a loop.

The zippers 134 are conventional and are attached to the main section 130 along the slots 138,140 so that the flaps 142 and door 144 can be selectively opened and closed. While the zippers 134 are preferred, it is within the ambit of the present where an alternative fastener is used to hold each flap 142 and door 144 open or closed along the length of the respective slot 138,140.

The removable end cover 78 is preferably removably attached to the main cover 74 with a continuous zipper 146 that extends along the side of the main cover 74 (see FIG. 10). However, the principles of the present invention are applicable where the end cover 78 and main cover 74 are removably attached to each other with alternative fasteners. Also, while the end cover 78 is preferably removably attached to the main cover 74, it is within the ambit of the present invention where end cover 78 is fixed to the main cover 74.

While the cover assembly 24 preferably includes the end cover 78 being removable from main cover 74, it is within the scope of the present invention where the cover assembly 24 comprises a unitary cover construction that is not separable into multiple sections. Also, while the illustrated cover assembly 24 preferably includes end covers 76,78, it is within the scope of the present invention where end covers 76,78 are not included.

The illustrated cover assembly 24 is preferably constructed of a pliable fabric. The pliable fabric is also preferably made from synthetic resin fibers, although natural fibers could be used without departing from the scope of the present invention. Also, for some aspects of the present invention, the cover assembly 24 could be provided by a non-fabric construction, such as a molded synthetic resin construction (e.g., where the cover is formed by thermal molding, rotomolding, or injection molding). In one such embodiment, the cover assembly could include a plurality of molded panels that are attached to the frame assembly and overlap one another to cooperatively provide a continuous, weather-resistant shell for the ground blind. For instance, molded panels could be removably attached to corresponding frame sections 34 so that each of the attached panels spans the framed area of the corresponding frame section 34. Also, each adjacent pair of attached molded panels could overlap one another when the ground blind is erected so that the attached panels shed rain, snow, and other external elements. Yet further, the shell could include molded end panels that are removably attached to corresponding end frame sections 48,50 so that each of the attached molded end panels spans the framed area of the corresponding end frame section. Each pair of attached molded end panels could also overlap one another as well as adjacent molded panels that are attached to frame sections 34. In this manner, when the blind 20 is erected, the entire frame structure is substantially cooperatively spanned by the molded panels attached to frame sections 34,48,50 so as to form the continuous shell. It will be appreciated that such an alternative cover could include various doors and windows that are selectively opened and closed to permit desired use of the blind 20.

In referring to the ground blind 20 as a semi-permanent construction, it will be understood that the ground blind 20 is preferably operable to be setup or taken down in a time that ranges from about one (1) minute to about ten (10) minutes and, more preferably, ranges from about three (3) to four (4) minutes. Also, the semi-permanent blind 20 is preferably operable to be setup or taken down in the above-referenced times by one or two people.

Yet further, to provide a semi-permanent structure that is portable, the blind 20 preferably has a size and weight such that the blind can be transported manually by one or two people. The ground blind 20 preferably has a weight that ranges from about (20) pounds to about one hundred (100) pounds and, more preferably, is about seventy (70) pounds.

In the erected configuration, the blind 20 is preferably dimensioned to accommodate at least two users. Preferably, the blind 20 has a height dimension that ranges from about sixty (60) inches to about eighty (80) inches and, more preferably, is about seventy-three (73) inches. The width dimension W preferably ranges from about sixty (60) inches to about eighty (80) inches and, more preferably, is about seventy-two (72) inches. Also, the blind 20 presents a maximum lateral dimension M that ranges from sixty (60) inches to about eighty (80) inches and, more preferably, is about seventy-four (74) inches (see FIG. 10).

In the collapsed configuration, the articulated frame 26 preferably presents the width dimension W, a collapsed lateral dimension C, and a minimum collapsed thickness dimension (see FIG. 18). The collapsed lateral dimension C preferably ranges from about twenty (20) inches to about thirty (30) inches and, more preferably, is about twenty-four (24) inches. The minimum collapsed thickness dimension preferably ranges from about four (4) inches to about twelve (12) inches.

Turning to FIGS. 11 and 18, the articulated frame 26 is preferably shiftable between the collapsed and erected configurations. Again, in the erected configuration, the articulated frame 26 preferably takes on a generally cylindrical shape where the width dimension W is substantially constant along the length of the articulated frame 26. Thus, the blind 20 is sized and shaped to resemble the size and shape of a conventional round hay bale. For some purposes, the articulated frame 26 in the erected configuration could have an alternative shape, e.g., a frustum, cone, pyramid, cuboid, or horizontal cylindrical segment. In the erected configuration, the frame sections are moved out of the folded positions so that the articulated frame 26 spans an erected area E along the bottom of the interior space S, with the erected area E preferably being greater than the framed area F1 (see FIG. 3).

In the collapsed configuration, the adjacent pairs of frame sections 34 are each preferably in the folded position. Furthermore, the frame sections 34, which are preferably connected in series with each other, are folded so that the frame sections 34 are preferably stacked in series with each other (see FIG. 18). In other words, where the frame sections 34 cooperatively present interior and exterior faces of the articulated frame 26, the articulated frame 26 is collapsed by folding the frame sections 34 in an alternating pattern. For instance, the articulated frame 26 is collapsed by folding first and second connected frame sections 34*a,b* so that the interior faces are facing one another, folding second and third connected frame sections 34*b,c* so that the exterior faces are facing one another, folding third and fourth connected frame sections 34*c,d* so that the interior faces are facing one another, etc.

Also, the planes P of the frame sections 34 are preferably substantially parallel to one another in the folded position. Furthermore, the framed areas F1 are preferably in substantial registry with one another. In this manner, it has been found that the articulated frame 26 assumes a very compact shape in the collapsed configuration. However, for some aspects of the present invention, the planes P of frame sections 34 could be in a nonparallel orientation relative to one another in the collapsed configuration. Also, the frame sections 34 could be out of registry in the collapsed configuration.

While the illustrated frame sections 34 preferably form the same rectangular shape, it is within the ambit of the present invention where the frame sections 34 share an alternative shape, such as a square, triangular, or trapezoidal frame shape. Also, while the frame sections 34 preferably share the same shape, the frame sections 34 could also have shapes different from one another, e.g., to provide a suitable shape for the ground blind 20.

Again, the frame assembly 22 preferably has removable end frames 28,30. However, the frame assembly 22 could also have an end frame structure permanently attached to the articulated frame 26. Furthermore, for some aspects of the present invention, the frame assembly 22 could be devoid of end frames 28,30 while still being self supporting and substantially rigid. For instance, the articulated frame 26 could include gussets to selectively secure adjacent frame sections 34 in the illustrated erected configuration while restricting relative pivotal movement therebetween. In another alternative consistent with the principles of the present invention, the frame sections 34 of the articulated frame 26 could share the same shape (e.g., triangular or trapezoidal) and be connected to one another in series so that the frame sections 34 assume an approximately pyramidal, conical, frusto-pyramidal, or frusto-conical shape when arranged in the erected configuration.

In use, the ground blind 20 is preferably erected by arranging the end frame 30 on the ground with the end frame sections unfolded. Then, the articulated frame 26 is preferably shifted from the collapsed configuration to the erected configuration by unfolding the frame sections 34 while the articulated frame 26 is supported with the side 82 along the ground. The unfolded articulated frame 26 is then attached to the unfolded end frame 30 with connectors 52.

The articulated and end frames 26,30 are then preferably rotated into an upright orientation. With the frames 26,30 in this upright orientation, the end frame 28 is preferably unfolded and attached to the articulated frame 26 along the side 82 with connectors 52. The rods 32 are then removably attached to the articulated frame 26 and preferably extend along frame sections 34*c,d,e,f*.

The main cover 74 is then positioned in covering relationship with the articulated and end frames 26,30, with the end sections being folded over corresponding parts of the articulated and end frames 26,30 to secure the main cover 74. The removable end cover 78 is then secured to the main cover 74 with zipper 146 to be positioned in covering relationship with end frame 28. In the erected configuration, the illustrated blind 20 is preferably secured to the ground with the illustrated conventional lines L and anchors An, although other anchoring structures could be used.

The ground blind 20 is preferably collapsed by initially detaching the illustrated lines L and anchors An from the blind 20. Also, the removable end cover 78 can be unzipped and thereby preferably entirely detached from main cover 74. The main cover 74 and fixed end cover 76 can then be removed from the frame assembly 22.

With the cover assembly 24 removed, rods 32 can be detached and from articulated frame 26 and the frames 26,28, 30 can be selectively detached from one another. For instance, one of the end frames 28,30 can be selectively detached with the frame assembly 22 in the upright position. The remainder of the frame assembly 22 can then be rotated so that the other end frame lies on the ground. The articulated frame 26 can then be detached from the other end frame. With the end frames 28,30 being detached, each end frame 28,30 can be shifted into the folded position (see FIG. 18). Also, the articulated frame 26 can be shifted into the folded position so that the frame sections 34 are stacked in series with one another.

Turning to FIGS. 19-24, an alternative ground blind 200 is constructed in accordance with a second embodiment of the present invention. For the sake of brevity, the remaining description will focus primarily on the differences of this alternative embodiment from the first embodiment described above. The alternative ground blind 200 includes an alternative frame assembly 202 and an alternative cover assembly 204.

The illustrated frame assembly 202 provides a preferred support structure for blind 200. The frame assembly 202 preferably includes an articulated frame 206, a pair of alternative end frame assemblies 208 supported at opposite ends of frame assembly 202, and elongated upper support rods 209. The articulated frame 206 preferably includes tubular frame sections 210*a-h* and hinge devices 212 that interconnect adjacent pairs of the frame sections 210.

Each of the end frame assemblies 208 preferably includes a set of end rods 214*a-k*, hinge elements 216 that pivotally support one end of the end rods 214, a hub assembly 218, and connectors 220.

End rods 214*a-k* each preferably comprise a unitary rod construction. Preferably, the end rods 214*a-f* are each pivotally attached at one end thereof to a respective one of the frame sections 210 one of the hinge elements 216. The other ends of rods 214*a-f* are preferably removably attached to hub assembly 218. Each hinge element 216 includes a tube section 222 and tabs 224, with a fastener 226 that extends through the tabs 224 (see FIGS. 21 and 22). Each tube section 222 is rotatably mounted on a corresponding one of the frame sections 210. The end rods 214*a-f* are attached to tabs 224 with fasteners 226 that extend through a hole (not shown) in the end rod 214*a-f*.

The end rods 214*g-j* are pivotally attached to respective ones of end rods 214*a-f* with hinge elements 216. The end rods 214*g-j* are also removably attached to respective frame sections 210 with connectors 220. End rod 214*k* is pivotally attached to frame section 210*a* with a hinge element 216 and removably attached to frame section 210*h* with a connector 220.

The end rods 214 are each preferably pivotal between the collapsed configuration and the erected configuration. In the collapsed configuration, the end rods 214 are folded so that each end rod 214 extends along and is substantially parallel to the plane P of the frame section 210 that supports the end rod 214. Furthermore, the folded end rods 214 also preferably lie within the outermost margin of the frame section 210 that supports the end rod 214 in the collapsed configuration. In the erected configuration, the end rods 214 are moved into an erected position to cooperatively form an end frame structure that supports the articulated frame 206 (see FIG. 20).

The hub assembly 218 includes a base plate 228, a cover plate 230, a threaded bolt 232 fixed to the cover plate 230, and a threaded nut 234. The nut 234 is tethered to the base plate 228 and is removably threaded onto the bolt 232. The base plate 228 and cover plate 230 each present a plurality of slots 236 operable to receive respective end rods 214. The end rods 214 are preferably snapped into respective slots 236 so that the slots 236 restrict sliding movement of the end rods 214 out of the slots 236. The base plate 228 and cover plate 230 each also include an integral sleeve 237. The sleeve 237 of base plate 228 has end rod 214*b* secured thereto with a fastener. Sleeve 237 of cover plate 230 has end rod 214*f* secured thereto with a fastener.

The plates 228,230 are removably secured to each other by threading the nut 234 onto the bolt 232. Thus, the secured plates 228,230 cooperatively receive and secure the end rods 214*a-f* in the erected configuration and restrict relative movement of the end rods 214*a-f*.

Turning to FIG. 19, the alternative cover assembly 204 preferably includes an alternative removable end cover 238 including a unitary main section 240, bottom sections 242, and zippers 244. The main section 240 preferably comprises a fabric sheet that presents interior and exterior surfaces, a continuous outer margin, and slots 246,248 that define movable flaps 250 and a door 252.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A collapsible enclosure comprising:

a frame assembly including an articulated frame that extends between and presents opposite frame ends; and a cover attached to the frame assembly so that the frame assembly and cover cooperatively define an interior space, said articulated frame including a plurality of rigid frame sections that each define a framed area, said frame sections being attached in series with one another to extend continuously between the frame ends and present multiple adjacent pairs of frame sections, each of said adjacent pairs of frame sections being pivotally attached to one another by at least one pivot joint so as to be pivotal into and out of a folded position where the framed areas are positioned adjacent one another, said articulated frame being shiftable between a collapsed configuration where each of the adjacent pairs of frame sections are moved into the folded positions so that the frame sections are stacked in series with one another and an erected configuration where each of the adjacent pairs of frame sections are moved out of the folded positions so that the articulated frame spans an erected area along the interior space greater than the framed area, said frame assembly including a plurality of elongated flexible rods, said rods extending along the length of the articulated frame to interconnect multiple frame sections, said framed area of each of the multiple frame sections having a generally planar shape, with the attached cover being under tension in the erected configuration and thereby urged to conform along the planar shapes in the erected configuration, said rods extending along a curved path that extends at least partly out of the planes of the multiple frame sections so as to urge the attached cover out of conformity with the planar shapes of the multiple frame sections.

2. The collapsible enclosure as claimed in claim 1, each of said adjacent pairs of frame sections being interconnected by a respective hinge device that provides the at least one pivot joint, with each of the hinge devices being attached to corresponding adjacent frame sections.

3. The collapsible enclosure as claimed in claim 2, each of said hinge devices including a pair of hinge elements attached to one another, said pair of hinge elements being pivotally attached to respective ones of the adjacent frame sections to define adjacent pivot joints that permit relative pivotal movement between the respective adjacent pair of frame sections.

4. The collapsible enclosure as claimed in claim 3, each of said pair of hinge elements comprising tubular hinge elements, with the respective adjacent frame section including an insert hinge element rotatably received by the tubular hinge elements.

5. The collapsible enclosure as claimed in claim 4, each of said hinge devices including a pair of tubular bushings secured within respective tubular hinge elements and rotatably receiving respective insert hinge elements.

6. The collapsible enclosure as claimed in claim 5, said pair of tubular bushings being in rotational frictional engagement with the respective insert hinge elements.

7. The collapsible enclosure as claimed in claim 5, said pair of tubular bushings each including a material selected from the group consisting of nylon and ultra-high-molecular-weight polyethylene.

8. The collapsible enclosure as claimed in claim 1, said frame sections each presenting opposite section ends, with at least one of the section ends of each frame section being pivotally attached to a section end of an adjacent frame section by the at least one pivot joint.

9. The collapsible enclosure as claimed in claim 8, said frame sections each presenting opposite sides that define a section width dimension, with the section width dimension being substantially constant along a length of the articulated frame.

10. The collapsible enclosure as claimed in claim 8, said frame assembly including a pair of end frames including the first mentioned end frame, with the end frames being attached to respective frame sides to support the articulated frame in the erected configuration.

11. The collapsible enclosure as claimed in claim 10, at least one of said pair of end frames including multiple end frame sections that each define an end framed area, said end frame sections being attached in series with one another to present at least one adjacent pair of end frame sections, each of said at least one adjacent pair of end frame sections being pivotally attached to one another by at least one end pivot joint so as to be pivotal into and out of another folded position where the end framed areas are positioned adjacent one another.

12. The collapsible enclosure as claimed in claim 10, said frame assembly including a plurality of connectors that removably connect the articulating frame and the pair of end frames.

13. The collapsible enclosure as claimed in claim 12, said plurality of connectors being removably attached to the articulating frame at connections, said plurality of connectors being removably mounted and retained on the pair of end frames.

14. The collapsible enclosure as claimed in claim 12, said plurality of connectors being removably attached to the articulating frame at connections that are tool-less so that the frame assembly is operable to be erected without tools.

15. The collapsible enclosure as claimed in claim 14, said plurality of connectors each comprising a clamp with tabs that present an open end, with the tabs of the clamp grabbing and holding the respective end frame when the respective end frame is passed through the open end and into engagement with the clamp.

16. The collapsible enclosure as claimed in claim 1, said frame sections including a plurality of steel tubes fixed to one another.

17. The collapsible enclosure as claimed in claim 1, said cover being attached to the frame assembly to substantially cover the erected area.

18. The collapsible enclosure as claimed in claim 17, said cover being removably attached to the frame assembly.

19. The collapsible enclosure as claimed in claim 18, said cover including a pliable fabric, said cover being attached to the frame assembly only adjacent the frame ends.

20. The collapsible enclosure as claimed in claim 17, said cover presenting interior and exterior surfaces, said cover including a plurality of brush connectors located along the exterior surface to attach camouflaging brush to the collapsible enclosure.

21. The collapsible enclosure as claimed in claim 20, said cover including at least one fabric strip attached to the exterior surface to provide the brush connectors.

22. The collapsible enclosure as claimed in claim 1, said frame sections each presenting a plane that extends along the framed area, each of said adjacent pairs of frame sections being located in the folded position so that the corresponding planes are substantially parallel to one another.

23. The collapsible enclosure as claimed in claim 1, each of said frame sections being attached to the end frame by a corresponding pair of the connectors.

24. The collapsible enclosure as claimed in claim 1, said end frame extending along each of the frame sections along the one frame side.

* * * * *